US008091975B2

(12) United States Patent
Kaneko et al.

(10) Patent No.: US 8,091,975 B2
(45) Date of Patent: Jan. 10, 2012

(54) INKJET PRINTING APPARATUS AND INKJET PRINTING METHOD

(75) Inventors: Takumi Kaneko, Tokyo (JP); Takao Ogata, Tokyo (JP); Rie Takekoshi, Kawasaki (JP); Noboru Kunimine, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 12/131,573

(22) Filed: Jun. 2, 2008

(65) Prior Publication Data

US 2008/0246791 A1 Oct. 9, 2008

Related U.S. Application Data

(63) Continuation of application No. PCT/JP2007/074440, filed on Dec. 19, 2007.

(30) Foreign Application Priority Data

Dec. 19, 2006 (JP) ..... 2006-341390

(51) Int. Cl.
*B41J 29/38* (2006.01)

(52) U.S. Cl. ..... 347/14; 347/19

(58) Field of Classification Search ..... 347/19, 347/14

See application file for complete search history.

(56) References Cited

U.S. PATENT DOCUMENTS

| | | | | |
|---|---|---|---|---|
| 6,517,192 | B2 | 2/2003 | Kaneko et al. | |
| 7,121,641 | B2 | 10/2006 | Nitta et al. | |
| 2002/0154185 | A1 * | 10/2002 | Bauer | 347/14 |
| 2002/0158942 | A1 * | 10/2002 | Kaneko et al. | 347/43 |
| 2004/0050291 | A1 * | 3/2004 | Taguchi et al. | 106/31.27 |
| 2006/0125895 | A1 * | 6/2006 | Nito et al. | 347/100 |
| 2006/0227194 | A1 * | 10/2006 | Hoshino | 347/102 |

FOREIGN PATENT DOCUMENTS

| | | | |
|---|---|---|---|
| JP | 2001-138554 | A | 5/2001 |
| JP | 2001-260331 | A | 9/2001 |
| JP | 2002-248798 | A | 9/2002 |
| JP | 2004-209943 | A | 7/2004 |
| JP | 2005-81754 | A | 3/2005 |
| JP | 2005-103920 | A | 4/2005 |
| JP | 2006-130778 | A | 5/2006 |

* cited by examiner

*Primary Examiner* — Laura Martin
(74) *Attorney, Agent, or Firm* — Fitzpatrick, Cella, Harper & Scinto

(57) ABSTRACT

One or more scans used to apply a specific ink are varied according to the overlapping conditions of the specific ink and a non-specific ink, and bias in the specific ink nozzle usage frequency and bias in the printing ratio among passes is suppressed. For this purpose, one or more scans used to apply the specific ink are determined on the basis of applying amount information for the specific ink and the non-specific ink. For example, the one or more scans used to apply the specific ink are determined such that the ratio of specific ink applied by the last half of plural scans is greater for a unit pixel whose application ratio of non-specific ink to specific ink is greater than a predetermined ratio than for a unit pixel whose application ratio of non-specific ink to the specific ink is less than the predetermined ratio.

12 Claims, 25 Drawing Sheets

| GRADIENT DATA | NUMBER OF DOTS | DOT DISTRIBUTION |
|---|---|---|
| 0000 | 0 | |
| 0001 | 1 | |
| 0010 | 2 | |
| 0011 | 3 | |
| 0100 | 4 | |
| 0101 | 5 | |
| 0110 | 6 | |
| 0111 | 7 | |
| 1000 | 8 | |

FIG.19

INKJET PRINTING APPARATUS AND INKJET PRINTING METHOD

This application is a continuation of Application No. PCT/JP2007/074440, filed Dec. 19, 2007, the entire disclosure of which is incorporated herein by reference.

BACKGROUND OF THE INVENTION

1. Field of the Invention

The present invention relates to inkjet printing apparatuses and inkjet printing methods wherein an image is formed by scanning printing means across a print medium, the printing means ejecting a plurality types of ink thereupon.

2. Description of the Related Art

Inkjet printing apparatuses have a variety of advantages, such as being able to print at high densities and speeds, and being a printing method that is quiet and whose running costs are low. Inkjet printing apparatuses are being commercialized in a variety of configurations, being used as the output device for various apparatuses and in portable printers. Particularly in recent years, a great number of printing apparatuses that form a color image using a plurality of colors of ink have been provided.

An inkjet printing apparatus is typically provided with printing means (a print head) that ejects inks according to a printing signal, a carriage that houses this print head and an ink tank, conveying means that conveys the print medium, and control means that controls these components. In serial scan type inkjet printing apparatuses, a printing operation in which the carriage serially scans in a main print scan and a conveying operation in which the print medium is conveyed in a sub-scan direction that intersects the main print scan direction, are repeated alternately. Herewith, an image is gradually formed. Ink tanks for four or more colors are mounted on the carriage, and by printing these inks in single colors or in combinations of colors on the print medium, a full color image can be formed.

Meanwhile, it is known that in inkjet printing methods the order in which these plurality of inks are applied to the print medium can have a variety of effects on the print image. For example, Japanese Patent Laid-Open No. 2002-248798 discloses how, depending on the order in which ink is applied to the print medium, the chromaticity (i.e., the colors in the image) changes in image. This literature states that, with respect to inkjet paper, the initially applied inks exhibit stronger color.

In addition, Japanese Patent Laid-Open No. 2005-81754 discloses a technology that improves scratch resistance of an image by applying an additional a coating liquid after forming an image using coloring inks. Scratch resistance herein refers to an image's resistance against rubbing or scraping the print material with a fingernail or cloth. Since this type of a coating liquid shows its effectiveness by being applied to the print medium after image formation, its effectiveness is reduced if applied before image formation.

As described above, the quality of print material can be further improved for inkjet printing apparatuses by deliberately adjusting the application order of the inks. For this reason, in order to control the application order of the inks with respect to the print medium, the arrangement of the nozzle rows that eject each color/type of ink becomes an important element.

Typically, print head configurations in serial type color inkjet printing apparatuses can be divided into two broad types. The first is a vertically-arranged configuration wherein the nozzle row for each color is arranged in the sub-scan direction on the print head. The second is a horizontally-arranged configuration wherein the nozzle row for each color is arranged horizontally in the main scan direction. Hereinafter, these configurations will be described in turn.

FIG. 1 is a schematic diagram for illustrating the vertically-arranged print head configuration. Herein, a yellow ink nozzle row 15Y, a magenta ink nozzle row 15M, a cyan ink nozzle row 15C, and a black ink nozzle row 15K are disposed on a print head 151 in a single line in the sub-scan direction, such that the nozzle rows are mutually non-overlapping. In a vertically-arranged configuration such as this, in one main print scan of the print head, each color of ink is applied to a different region of the print medium. As a result, the order in which ink is applied to the print medium is black cyan magenta yellow, regardless of whether the print head 151 performs a main print scan in either the forward direction or the backward direction. For example, for a blue image, being expressed by a mixture of cyan and magenta, ink is always applied in the order cyan→magenta. For a print head configuration such as this, an image can be formed with the target ink application order without conducting any particularly difficult control, even when using a coating liquid like that described above. The nozzle row for ejecting the coating liquid need only to be positioned farthest downstream in the sub-scan direction.

However, for the print head of vertically-arranged configuration such as this, although the application order of ink with respect to the print medium can be fixed, it is difficult to change this order according to conditions. In addition, since the nozzle rows for each color are arranged in a single line in the sub-scan direction, there is a tendency for the print head to become lengthened in the sub-scan direction. Lengthening of the print head leads to enlargement of the entire apparatus, makes the mechanism that presses on the print medium more complex, and leads to higher costs for not only the print head itself, but also the apparatus as a whole.

FIG. 2 is a schematic diagram for describing the horizontally-arranged configuration of the print head. In this case, a yellow ink nozzle row 17Y, a magenta ink nozzle row 17M, a cyan ink nozzle row 17C, and a black ink nozzle row 17K are disposed on the print head parallel to the main scan direction. In a horizontally-arranged configuration such as this, there is not a tendency for the print head to become lengthened compared to the vertically-arranged configuration. Thus a printing apparatus that is comparatively compact and low cost can be realized.

However, in the case of the print head of horizontally-arranged configuration, each color of ink is applied to the same region of the print medium during one main print scan of the print head. Consequently, for scans in the forward direction, ink is applied in the order yellow→magenta→cyan→black, but for scans in the backward direction, this order is reversed. As described in the foregoing, in ink jet printing, the coloration of the reproduced image changes according to the order in which inks are applied to the print medium. Consequently, this reversal of the ink application order that occurs in each print scan is a factor that degrades image quality. For example, for blue images, which are reproduced by a mixture of cyan and magenta, alternating bands appear in which ink is applied in the order cyan magenta to form one band, and magenta cyan to form the other band. The result is clearly visible as color banding.

In order to cope with this problem, inkjet printing apparatuses typically implement a printing method known as multi-pass printing. In multi-pass printing, image data which can be printed by one main print scan is thinned out according to a mask pattern prepared in advance. The image data is gradually printed by a plurality of main print scans.

FIG. 3 is a schematic diagram for simply describing multi-pass printing. In this case, FIG. 3 illustrates the state wherein an image is printed on a print medium 52 using a print head 51 via 4-pass multi-pass printing. Between each main print scan, the print medium 52 is conveyed in the sub-scan direction by a quantity d equivalent to ¼ of the print width of the print head. In a print method such as this, an image of a unit region of the print medium 52 is completed by four main print scans corresponding to four regions 1-4 of the print head. As a result, the plurality of dot arranged on the print medium in the main scan direction are printed by four different nozzles. This alleviates adverse affect of nozzle variations, and the overall image becomes smoother. In addition, even when conducting bi-directional printing, ink will be applied to all of the image regions of the print medium 52 by both forward scans and backward scans. Thus the order in which ink is applied to the print medium will not differ depending on the band, and to some degree color banding appears in the overall image is curtailed.

FIG. 4 illustrates an example of mask patterns used when performing 4-pass multi-pass printing as in FIG. 3. In this case, a single color nozzle row 56 and its corresponding mask patterns 57*a*-57*d* are shown for the sake of simplicity. Nozzles in the nozzle row are divided into four regions. The nozzles contained in the respective regions print dots according to the mask patterns 57*a*-57*d* corresponding to each region. The individual mask patterns 57*a*-57*d* are comprised of a plurality of pixel areas, each pixel area determining whether the printing of a dot is permitted or not permitted. In FIG. 4, the black areas are the pixels where the printing of a dot is permitted, and the white areas are the pixels where the printing of a dot is not permitted. The four types of mask patterns 57*a*-57*d* exist in a complementary relationship, and by taking the logical product of these mask patterns and the image data for each print scan, the actual printed dots for each main print scan are determined. For the sake of simplicity, mask patterns having a 4-pixel×3-pixel area are shown herein, but practical mask patterns have much larger areas in both the main scan direction and the sub-scan direction.

If a multi-pass printing method such as this is implemented, the printing ratio for each region of the mask patterns can be made different in every color, even when using a print head of horizontally-arranged configuration. It is also possible to control to a certain degree the order in which ink is applied to the print medium, similar to the print head of the vertically-arranged configuration.

FIG. 5 illustrates an example of mask patterns devised such that, from among four colors, only yellow ink, for example, is to be applied to the print medium after other inks as much as possible. A nozzle row 61 illustrates the nozzle rows for cyan, magenta, or black, all of which print an image according to mask patterns 63*a*-63*d*. On the other hand, a yellow nozzle row 62 prints an image according to mask patterns 64*a*-64*d*. By preparing in advance such mask patterns, cyan, magenta, and black are used to print an image in four main print scans, each scan printing 25%. On the fourth pass, 100% of the yellow printing is conducted at the same time. As a result, there is a higher probability that the yellow ink will be applied after the application of the other inks.

However, for cases wherein mask patterns such as those illustrated in FIG. 5 are implemented, yellow ink can only be printed using the nozzles contained in region 4. In other words, even in cases where color banding is not a concern, such as when printing yellow as a single color, the nozzles for regions 1-3 are not used. If such a bias in the usage frequency among the plurality of nozzles exists in the nozzle row, the alleviation adverse affect of nozzle variability and the smoothing of the overall image, i.e., the original merits of multi-pass printing, are easily impaired. In addition, nozzle life depends on the number of nozzle ejections, and the print head may be declared unusable if even one nozzle exhibits ejection trouble. In other words, causing bias in usage frequency within the nozzle row leads to the shortening of the life of the print head itself.

In configurations of the conventional art like that described above, devices are controlled such that specific ink (yellow ink) is always applied with a scan subsequent to that of non-specific ink (cyan, magenta and black ink), regardless of the overlapping conditions of the specific ink and the non-specific ink. Thus, the above-described bias has been larger than necessary.

SUMMARY OF THE INVENTION

The present invention was devised in the light of the foregoing problems. Consequently, it is an object of the invention to suppress bias in the specific ink nozzle usage frequency and bias in the printing ratio among passes by varying the one or more scans whereby (regions by which) the specific ink is applied according to the overlapping conditions of the specific ink and the non-specific ink.

The invention that achieves the above object is an inkjet printing apparatus for printing a unit pixel on a print medium by plural scans of a print head for applying a plurality of inks including a specific ink and a non-specific ink. The apparatus is provided with: an obtaining unit for obtaining applying amount information on amounts of respective inks to be applied to the unit pixel; and a determining unit for determining, for the respective inks, one or more scans used to apply the ink to the unit pixel among the plural scans on the basis of the applying amount information obtained by the obtaining unit. The determining unit determines the one or more scans used to apply the specific ink based on the applying amount information for the specific ink and the non-specific ink, and determines the one or more scans used to apply the non-specific ink based on the applying amount information for the non-specific ink.

In the above printing apparatus, it is preferable to determine the one or more scans used to apply the specific ink such that the ratio of the specific ink applied by the last half of the plural scans to the specific ink applied by the plural scans is greater for a unit pixel having an application ratio of non-specific ink to specific ink that is greater than a predetermined ratio than for a unit pixel having an application ratio of non-specific ink to specific ink that is less than a predetermined ratio.

In addition, it is preferable to determine the one or more scans used to apply the specific ink such that the probability that the specific ink will be applied by the last half of the plural scans is greater for a unit pixel having an application ratio of non-specific ink to specific ink that is greater than a predetermined ratio than for a unit pixel having an application ratio of non-specific ink to specific ink that is lower than a predetermined ratio. Herein, it is further preferable to determine the one or more scans used to apply the specific ink such that the probability that the specific ink will be applied by the last half of the plural scans as increases, the application ratio of non-specific ink to specific ink increases.

Adopting multi-valued density information as the above applying amount information is ideal. In addition, although it is ideal to designate, as the specific ink, an ink having scratch resistant properties superior to those of the non-specific ink, the basis for determining the specific ink is not limited to scratch resistant properties. This issue will become more apparent in the description hereinafter.

In addition, the present invention also includes an inkjet printing method for printing a unit pixel on a print medium by plural scans of a print head for applying a plurality of inks including a specific ink. The method includes: an obtaining step for obtaining applying amount information on the amounts of respective inks to be applied to the unit pixel; and a determining step for determining, for the respective inks, one or more scans used to apply the ink to the unit pixel among the plural scans on the basis of the applying amount information obtained in the obtaining step. In the determining step, the one or more scans used to apply the specific ink are determined on the basis of the applying amount information for the specific ink and the for the non-specific ink (i.e., all inks other than the specific ink), and the one or more scans used to apply the non-specific ink are determined on the basis of the applying amount information for the non-specific ink.

In addition, the present invention includes a printing system, the printing system including: an inkjet printing apparatus for printing in a unit pixel on a print medium by plural scans of a print head for applying a plurality of inks including a specific ink; and a host device for supplying information for printing to the inkjet apparatus. The printing system is provided with: an obtaining unit for obtaining applying amount information on the amount of respective inks to be applied to the unit pixel; and a determining unit for determining, for the respective inks, one or more scans used to apply the ink to the unit pixel among the plural scans on the basis of the applying amount information obtained by the obtaining unit. The determining unit determines the one or more scans used to apply the specific ink on the basis of the applying amount information for the specific ink and the non-specific ink (i.e., all inks other than the specific ink), and determines the one or more scans used to apply the non-specific ink on the basis of the applying amount information for the non-specific ink.

In addition, the present invention includes a program that executes, on a computer, processing for printing a unit pixel on a print medium by plural scans of a print head for applying a plurality of inks including a specific ink. This processing includes: an obtaining step for obtaining applying amount information on the amounts of respective inks to be applied to the unit pixel; and a determining step for determining, for each of the ink, one or more scans used to apply the ink to the unit pixel among the plural scans on the basis of the applying amount information obtained in the obtaining step. In the determining step, the one or more scans used to apply the specific ink are determined on the basis of the applying amount information for the specific ink and the non-specific ink (i.e., all inks other than the specific ink), and the one or more scans used to apply the non-specific ink are determined on the basis of the applying amount information for the non-specific ink.

Further features of the present invention will become apparent from the following description of exemplary embodiments (with reference to the attached drawings).

BRIEF DESCRIPTION OF THE DRAWINGS

FIG. 19 is a schematic diagram for describing a typical index patterning process;

DESCRIPTION OF THE EMBODIMENTS

Figure 1:
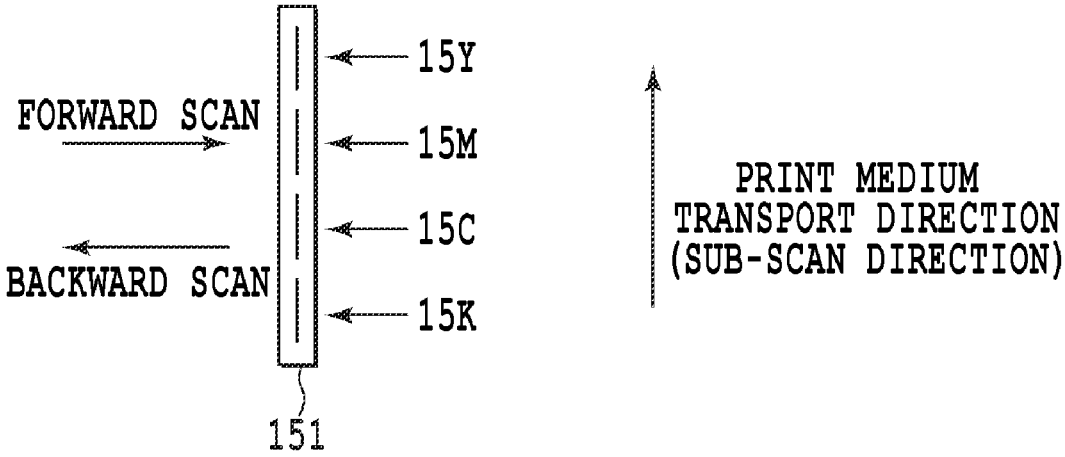
FIG. 1 is a schematic diagram for illustrating a print head of vertically-arranged configuration.
Figure 2:
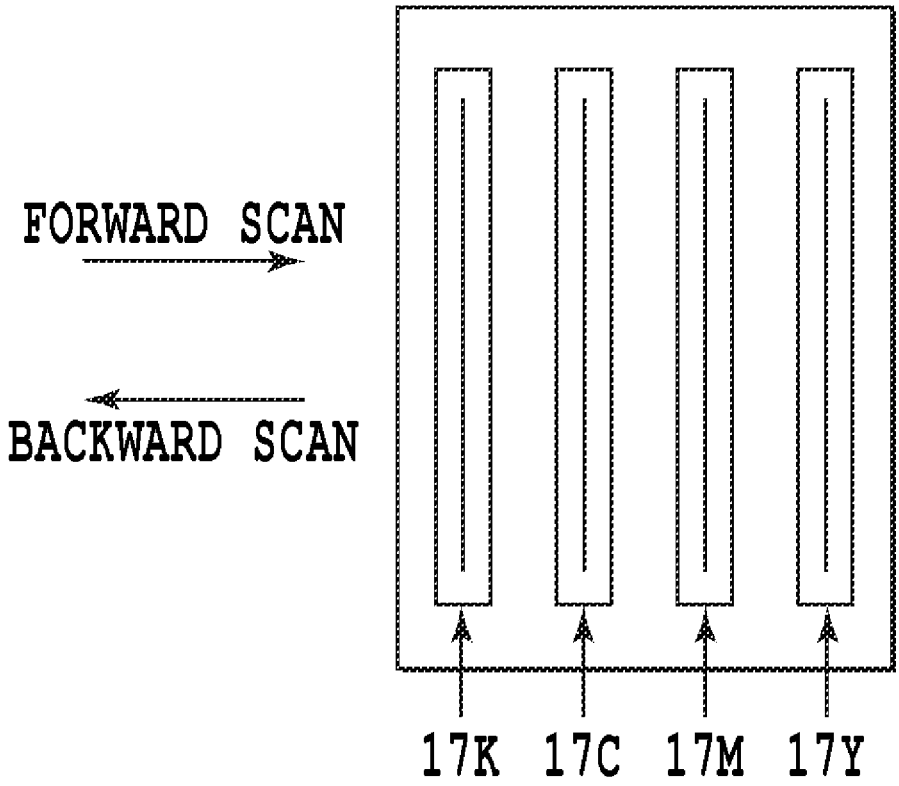
FIG. 2 is a schematic diagram for illustrating a print head of horizontally-arranged configuration.
Figure 3:
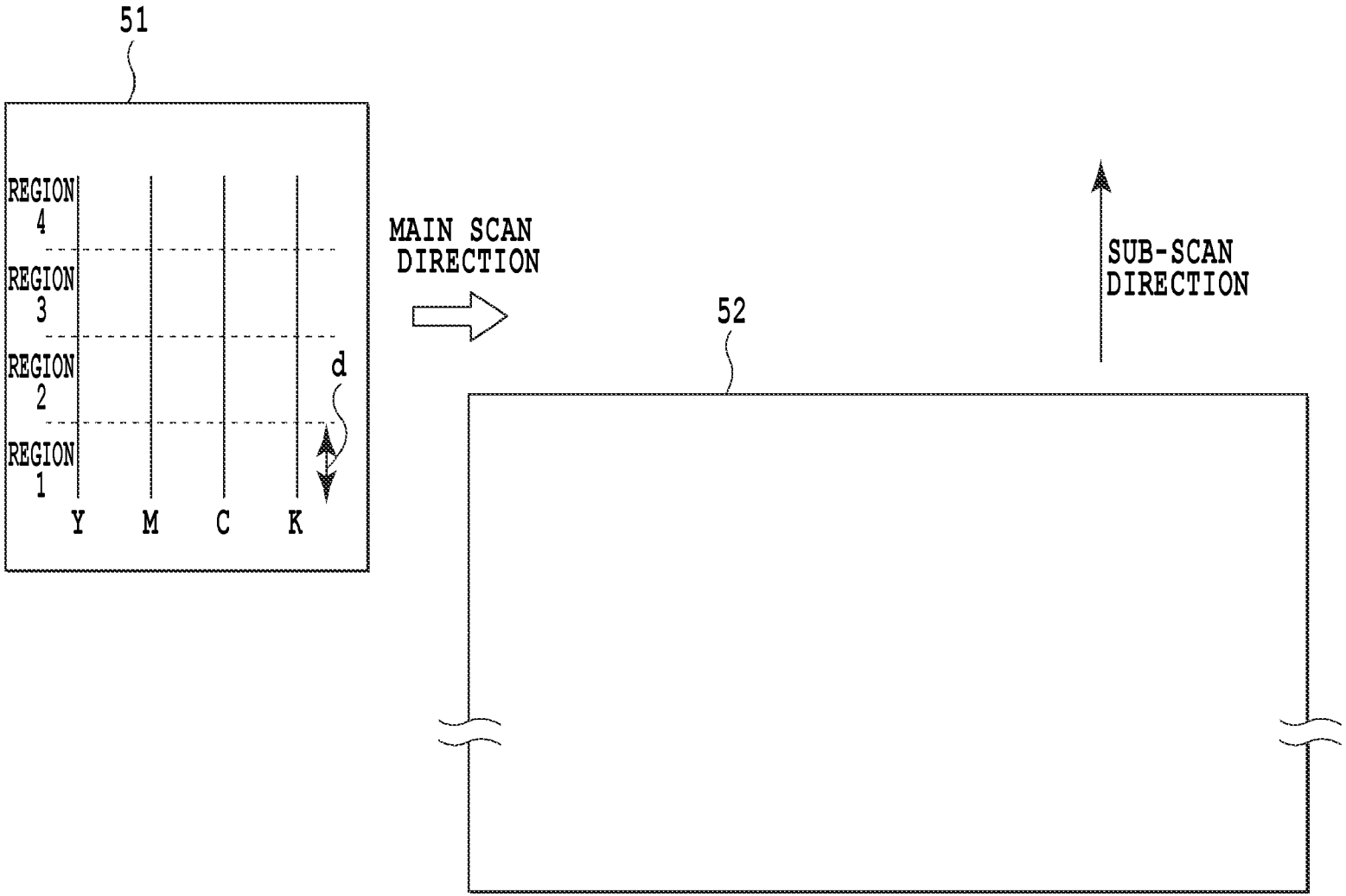
FIG. 3 is a schematic diagram for simply illustrating a multi-pass printing method.
Figure 4:
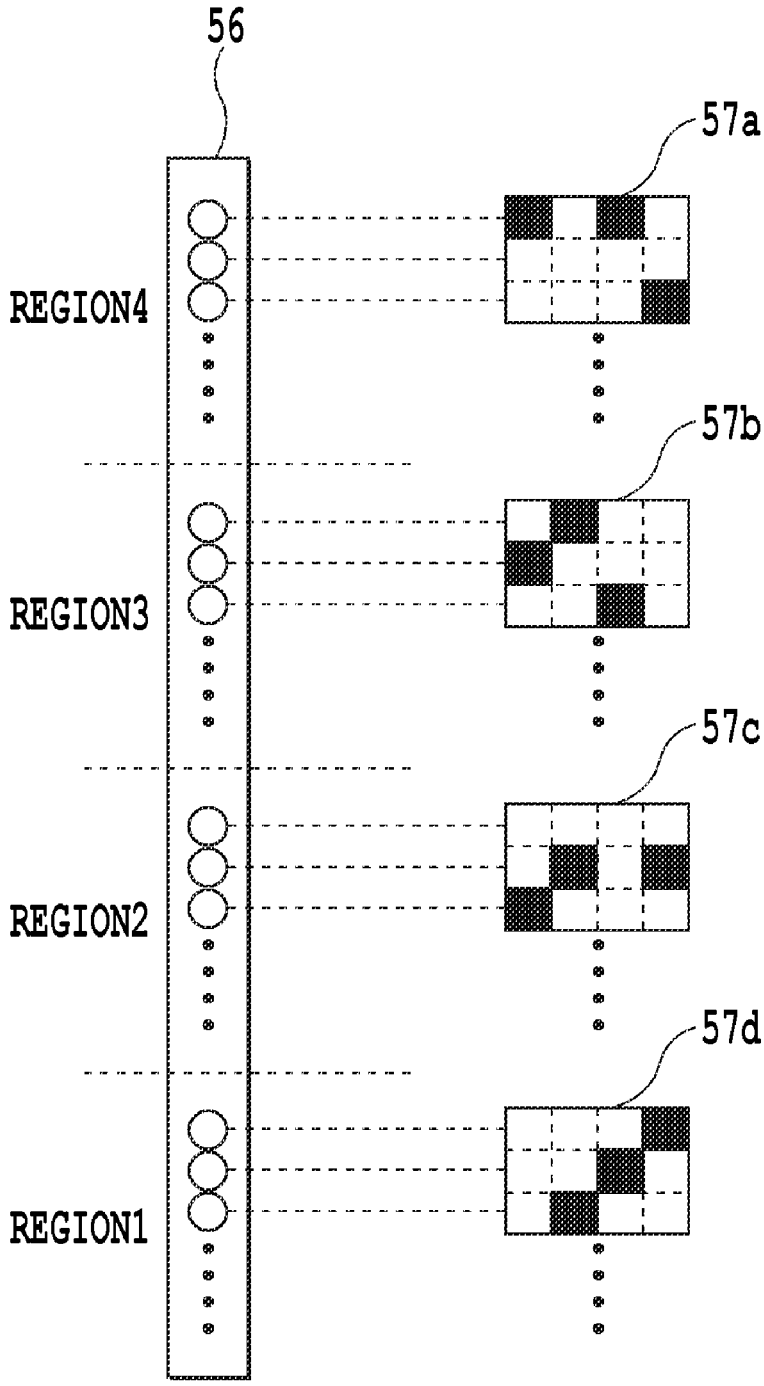
FIG. 4 is a diagram for illustrating an example of mask patterns to be used when performing 4-pass multi-pass printing.
Figure 5:
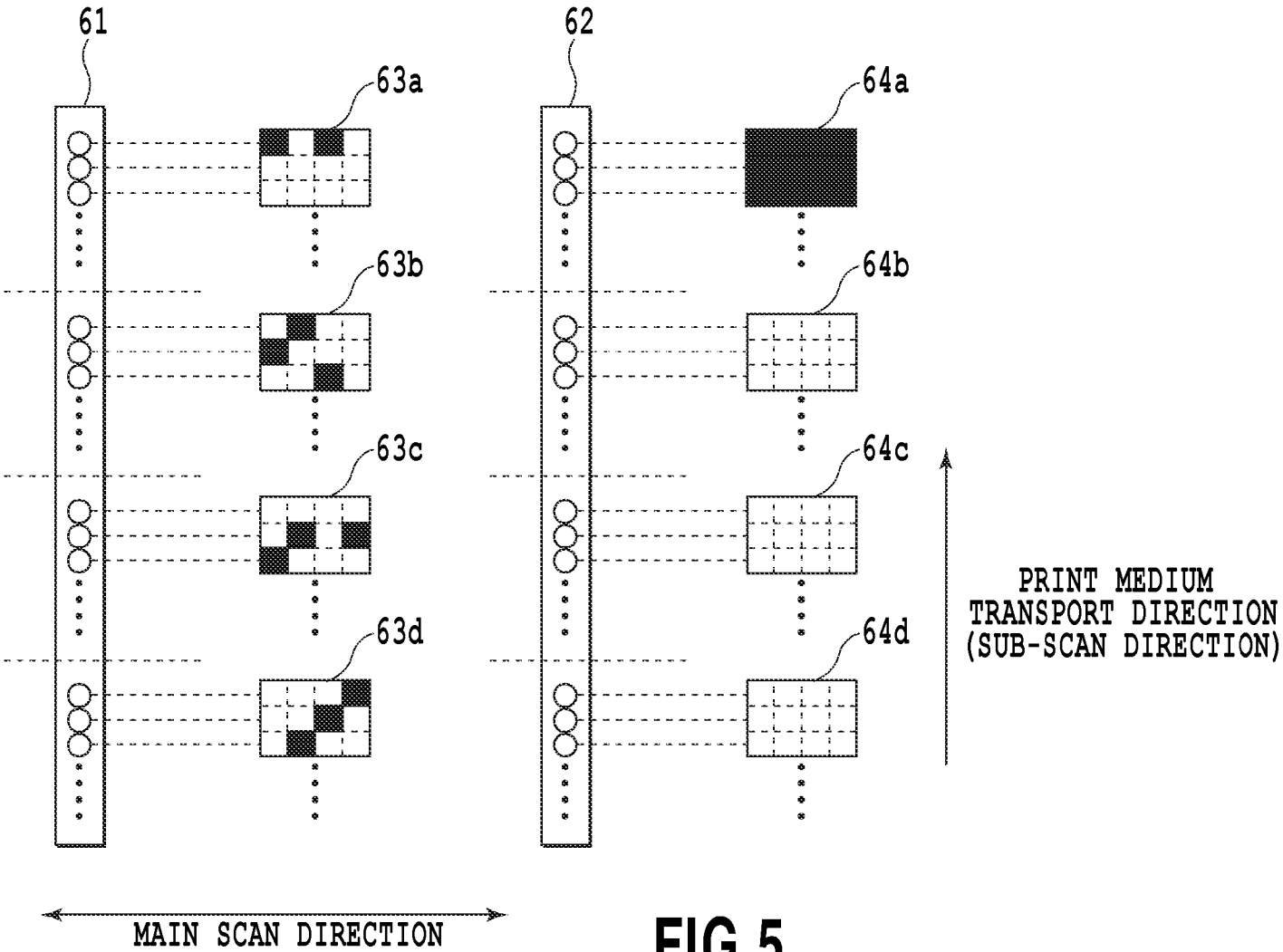
FIG. 5 is a diagram for illustrating an example of mask patterns devised such that yellow ink is applied to the print medium later than other inks as much as possible.

Hereinafter, embodiments of the present invention will be described in detail. First, the characteristics of the embodiments will be simply described.

First, common to all embodiments is the feature that, when determining the one or more scans among the plural scans that will be used to apply the specific ink to a unit region, not only the applying amount information for the specific ink but also the applying amount information for the non-specific ink is taken into account. In other words, whereas conventionally the one or more application scans used to apply the specific ink were determined based on only the applying amount information for the specific ink, in the present invention the one or more application scans used to apply the specific ink are determined based on the applying amount information for the specific ink and the applying amount information for the non-specific ink. In so doing, the one or more scans used to apply the specific ink can be varied according to the overlapping conditions of the specific ink and the non-specific ink, and bias in nozzle usage frequency of the specific ink as well as bias in the printing ratio among passes can be suppressed. For non-specific ink, on the other hand, the one or more scans used to apply the non-specific ink are determined based on the applying amount information for the non-specific ink, as per conventional methods.

In the first through the third embodiments, a unit pixel (a unit pixel satisfying a predetermined condition) to which a specific ink is to be applied together with a non-specific ink is specified based on the applying amount information for the specific ink and the non-specific ink. Next, one or more scans used to apply the specific ink are determined such that the ratio of the specific ink applied by the last half of the plural scans or the final scan of the plural scans is greater for a unit pixel that satisfies the predetermined condition than for a unit pixel that does not satisfy the predetermined condition. In so doing, the ratio of the specific ink used by the last half of the plural scans or the final scan increases for the unit pixels where the specific ink coexists with the non-specific ink. As a result, the probability increases that the specific ink will be applied by a later scan than that of the non-specific ink.

In contrast, in the fourth and fifth embodiments, an application ratio of non-specific ink to specific ink is specified for a unit pixel based on the applying amount information for the specific ink and the non-specific ink, and the one or more application scans used to apply the specific ink are made to differ according to this ratio. Specifically, a unit pixel (a unit pixel satisfying a predetermined condition) having a high ratio of non-specific ink to specific ink is specified based on the applying amount information for the specific ink and the non-specific ink. Next, one or more scans used to apply the specific ink are determined such that the ratio of specific ink applied by the last half of the plural scans or the final scan of the plural scans is greater, for a unit pixel that satisfies the predetermined condition, than at a unit pixel that does not satisfy the predetermined condition. In so doing, the ratio of specific ink used by the last half of the plural scans or the final scan increases for the unit pixel wherein the application ratio of non-specific ink to specific ink is greater than a predetermined ratio. As a result, the probability increases that the specific ink will be applied by a later scan than that of the non-specific ink.

First Embodiment

Figure 6:
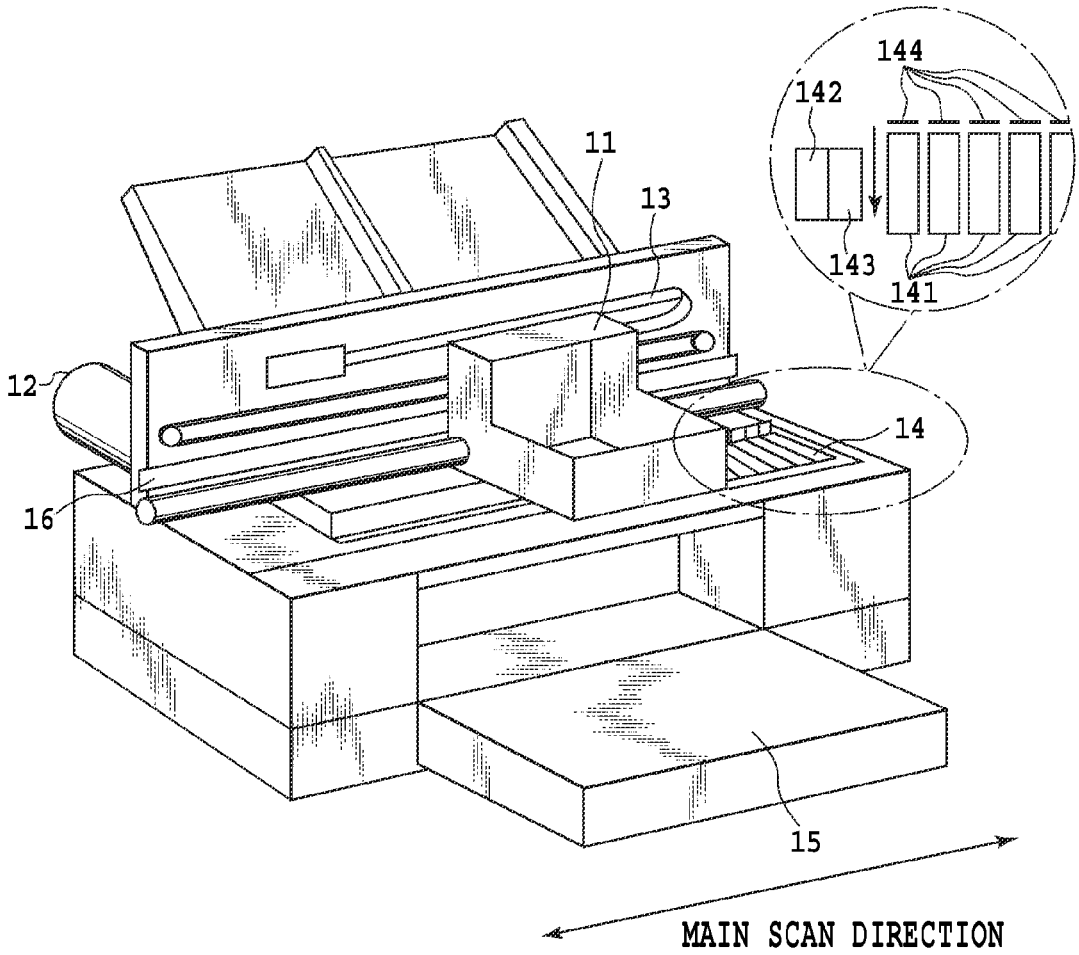
FIG. 6 is a diagram for illustrating a general configuration of an inkjet printing apparatus using in the embodiment of the present invention.

FIG. 6 is a diagram for illustrating the general configuration of an inkjet printing apparatus in accordance with the first embodiment. A carriage 11, upon which an inkjet print head and an ink tank containing a plurality of colors of ink are mounted, moves backwards and forwards in the main scan direction, and is driven by a carriage motor 12. A flexible cable 13, attached so as to follow the backward and forward movements of the carriage 11, transmits and receives electrical signals between a control portion (not shown in the drawings) and the print head mounted upon the carriage 11. The movement position of the carriage 11 is detected via an encoder sensor provided on the carriage, the encoder sensor optically reading an encoder 16 that is attached stretching in the main scan direction.

When a print operation command is input from an externally attached host device, one sheet of a print medium stacked in a paper feed tray 15 is fed to a location where printing can be conducted by the print head mounted upon the carriage 11. Subsequently, according to a print signal, the print head ejects ink while performing a plurality of main print scans, in alternation with a conveying operation that moves the print medium to a set amount. By repeating this operation, images are successively formed on the print medium.

Recovery unit 14 for executing maintenance processing of the print head is provided at the edge of movement region of the carriage 11. The recovery unit 14 is provided with a cap 141 that protects the ejection openings of the print head during suction and when not in operation, an ejection receiver 142 that receives a coating liquid during ejection recovery, as well as ejection receivers that receive ejected ink during ejection recovery. A wiper blade 144 wipes the ejection openings of the print head while moving in the direction of the arrow.

Figure 7:
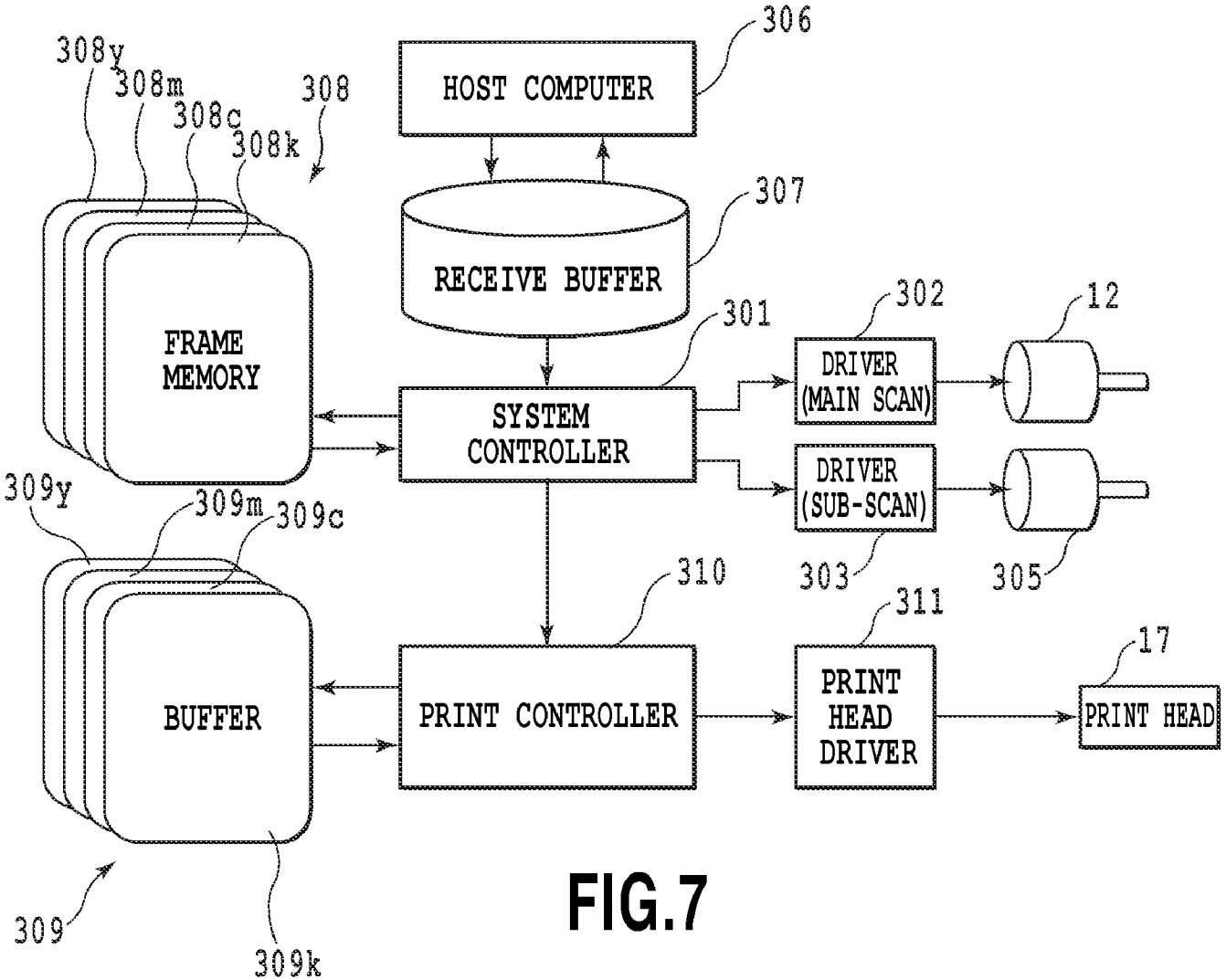
FIG. 7 is a block diagram for illustrating the control-related configuration of an inkjet printing apparatus using in the embodiment of the present invention.

FIG. 7 is a block diagram for illustrating the control-related configuration of the inkjet printing apparatus shown in FIG. 6. A system controller 301 processes image data received from external devices such as a host computer 306, etc., and controls the apparatus as a whole. The system controller 301 comprises: a microprocessor; a memory element (ROM) wherein information such as control programs, mask patterns, and index patterns (dot distribution patterns), to be hereinafter described, are stored; and RAM that serves as a work area when performing various image processing. For example, the system controller 301 uses an index pattern stored in the ROM to convert multi-level image data into binary image data (index expansion), and then stores this binary image data in a frame memory. A carriage motor 12 drives the print head in the main scan direction. A conveying motor 305 conveys the print medium in the sub-scan direction. Drivers 302 and 303 receive information such as the movement speed and movement distance of the print head and the print medium from the system controller 301, and respectively drive the motors 12 and 305.

An externally connected host computer 306 transfers image information to be printed to the inkjet printing apparatus of the present embodiment. The formation of the host computer 306, in addition to a computer acting as an information processing device, also includes formations such as an image reader or similar device. A receive buffer 307 temporarily stores data received from the host computer 306, and accumulates received data until the data is read by the system controller 301.

Frame memories 308 (308*k*, 308*c*, 308*m*, 308*y*) expand data to be printed into image data, and have the necessary memory sizes for printing for each ink color. Herein, frame memories capable of printing one sheet of print media are provided, but it should be appreciated that the frame memory is not limited to this size. Buffers 309 (309*k*, 309*c*, 309*m*, 309*y*) temporarily store data to be printed respectively for each ink color. The storage size of the buffer 309 varies according to the number of nozzles on the print head.

A print controller 310 controls the print head 17 in accordance with commands from the system controller 301, and controls factors such as the print speed and the print data number. A print head driver 311 is controlled by signals from the print controller 310, and drives the print head 17 so that ink is ejected.

In the foregoing configuration, image data supplied from a host computer 306 is transferred to and temporarily stored in the receive buffer 307, and expanded into the per-color frame memories 308 by the system controller 301. Next, the system controller 301 reads and performs predetermined image processing on the expanded image data, and the data is subsequently expanded into the per-color buffers 309. The print controller 310 controls the operation of the print head 17 based on the image data stored in each buffer.

Figure 8:
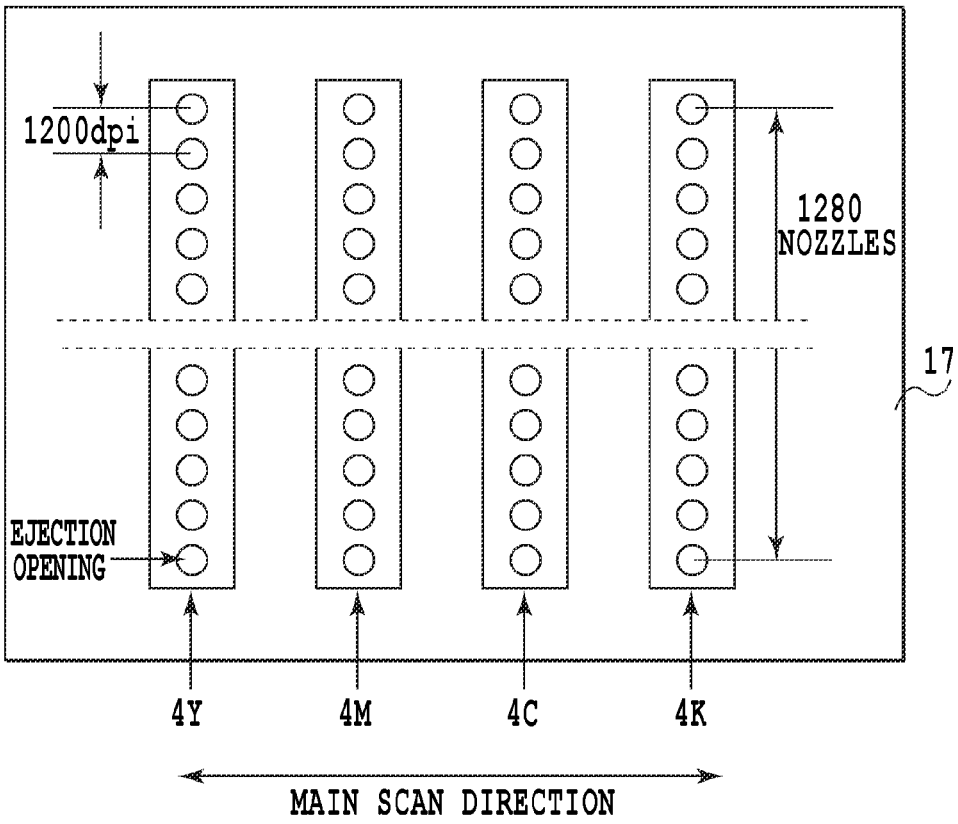
FIG. 8 is a schematic diagram for illustrating a view as seen from the ejection side of a print head used in the embodiment of the present invention.

FIG. 8 is a schematic diagram for illustrating a view as seen from the ejection opening side of the print head 17 used in the present embodiment. For each ink color, the print head 17 of the present embodiment has an ejection opening array (nozzle row) in which 1280 ejection openings are aligned in the sub-scan direction at a density of 1200 per 1 inch. Also, a nozzle row 4K that ejects black ink, a nozzle row 4C that ejects cyan ink, a nozzle row 4M that ejects magenta ink, and a nozzle row 4Y that ejects yellow ink are disposed parallel to the main scan direction of the print head. The ejection quantity of ink ejected from the ejection openings is herein taken to be approximately 4.5 pl. However, the ejection quantity for black ink may also be configured to be slightly larger compared to other inks, in order to produce higher density. By causing such a print head to eject ink while scanning in the main scan direction, the printing apparatus of the present embodiment is able to print dots at a print density of 2400 dpi (dots per inch) in the main scan direction, and 1200 dpi in the sub-scan direction.

Hereinafter, the components of the ink set applied in the present embodiment, and the refinement method thereof, will be described.

Yellow Ink (1) Manufacture of Dispersion Liquid 10 parts pigment [C.I. Pigment Yellow 74 (product name: Hansa Brilliant Yellow 5GX (mfg. by Clariant))], 30 parts anionic polymer P-1 [styrene/butyl-acrylate/acryl copolymer (copolymer ratio (weight ratio)=30/40/30), acid value 202, weight-average molecular weight 6500, 10% solid aqueous solution, neutralizer: potassium hydroxide], and 60 parts pure water are mixed. Next, the ingredients listed below are prepared in a batch-type vertical sand mill (mfg. by Aimex Co., Ltd.), packed with 150 parts zirconia beads having radius 0.3 mm, and dispersed for 12 hours underwater cooling. Furthermore, this dispersed liquid is transferred to a centrifugal separator where coarse particles are removed. Thus a pigment dispersion 1 that is 12.5% solid and having a weight-average particle radius of approximately 120 nm is obtained as the final preparatory product. Using this obtained pigment dispersion, ink is manufactured in the following manner.

(2) Manufacture of Ink

An ink 1 is prepared by combining the following components, the components being dissolved and dispersed by thorough mixing, and subsequently pressure filtered through a microfilter having a 1.0 μm pore size (mfg. by Fuji Film Ltd.).

| | |
|---|---|
| Pigment dispersion 1, obtained as above: | 40 parts |
| Glycerin: | 9 parts |
| Ethylene glycol: | 6 parts |
| Acetylene glycol-ethylene oxide adduct (product name: Acetylenol EH): | 1 part |
| 1,2-hexanediol: | 3 parts |
| Polyethylene glycol (molecular weight 1000): | 4 parts |
| Water: | 37 parts |

Magenta Ink (1) Manufacture of Dispersion Liquid

First, an AB-type block polymer having average molecular weight 2500 and acid number 300 is created via the typical procedure using benzyl acrylate and methacrylic acid as raw materials. The polymer is then neutralized in an aqueous solution of potassium hydroxide and diluted in ion-exchange water to create a 50% by mass homogenous aqueous polymer solution. In addition, 100 g of the above polymer solution is combined with 100 g of C.I. Pigment Red 122 and 300 g of ion-exchange water, and mechanically mixed for 0.5 hours. Next, a micro-fluidizer is used to pass this mixture through an interaction chamber 5 times at a fluid pressure of approximately 70 MPa. Furthermore, non-dispersed substances, including coarse particles, are removed by processing the obtained dispersion liquid in a centrifuge (12,000 rpm, 20 minutes), thus yielding a magenta dispersion liquid. The obtained magenta dispersion liquid has a pigment concentration of 10% by mass and a dispersant concentration of 5% by mass.

(2) Manufacture of Ink

The manufacture of the ink uses the above-described magenta dispersion liquid. The components below are added to the dispersion liquid to achieve a set concentration, these components being thoroughly combined by mixing, and subsequently pressure filtered through a microfilter having a pore size of 2.5 μm (mfg. by Fuji Film Ltd.). A pigment ink is thus prepared having a pigment concentration of 4% by mass and a dispersant concentration of 2% by mass.

| | |
|---|---|
| Magenta dispersion liquid as described above | 40 parts |
| Glycerin | 10 parts |
| Diethylene glycol | 10 parts |
| Acetylene glycol-EO adduct | 0.5 parts |
| Ion-exchange water | 39.5 parts |
| (mfg. by Kawaken Fine Chemicals) | |

Cyan Ink (1) Manufacture of Dispersion Liquid

First, an AB-type block polymer having average molecular weight 3000 and acid number 250 is created via the typical procedure using benzyl acrylate and methacrylic acid as raw materials. The polymer is then neutralized in an aqueous solution of potassium hydroxide and diluted in ion-exchange water to create a 50% by mass homogenous aqueous polymer solution. In addition, 180 g of the above polymer solution is combined with 100 g of C.I. Pigment Blue 15:3 and 220 g of ion-exchange water, and mechanically mixed for 0.5 hours. Next, a micro-fluidizer is used to pass this mixture through an interaction chamber 5 times at a fluid pressure of approximately 70 MPa. Furthermore, non-dispersed substances, including coarse particles, are removed by processing the obtained dispersion liquid in a centrifuge (12,000 rpm, 20 minutes), thus yielding a cyan dispersion liquid. The obtained cyan dispersion liquid has a pigment concentration of 10% by mass and a dispersant concentration of 10% by mass.

(2) Manufacture of Ink

The manufacture of the ink uses the above-described cyan dispersion liquid. The components below are added to the dispersion liquid to achieve a set concentration, these components being thoroughly combined by mixing, and subsequently pressure filtered through a microfilter having a pore size of 2.5 μm (mfg. by Fuji Film Ltd.). A pigment ink is thus prepared having a pigment concentration of 2% by mass and a dispersant concentration of 2% by mass.

| | |
|---|---|
| Cyan dispersion liquid as described above | 20 parts |
| Glycerin | 10 parts |
| Diethylene glycol | 10 parts |
| Acetylene glycol-EO adduct | 0.5 parts |
| Ion-exchange water | 53.5 parts |
| (mfg. by Kawaken Fine Chemicals) | |

Black Ink (1) Manufacture of Dispersion Liquid 100 g of the polymer solution used in the yellow ink 1 is combined with 100 g of carbon black and 300 g of ion-exchange water, and mechanically mixed for 0.5 hours. Next, a micro-fluidizer is used to pass this mixture through an interaction chamber 5 times at a fluid pressure of approximately 70 MPa. Furthermore, non-dispersed substances, including coarse particles, are removed by processing the obtained dispersion liquid in a centrifuge (12,000 rpm, 20 minutes), thus yielding a black dispersion liquid. The obtained black dispersion liquid has a pigment concentration of 10% by mass and a dispersant concentration of 6% by mass.

(2) Manufacture of Ink

The manufacture of the ink uses the above-described black dispersion liquid. The components below are added to the dispersion liquid to achieve a set concentration, these components being thoroughly combined by mixing, and subsequently pressure filtered through a microfilter having a pore size of 2.5 μm (mfg. by Fuji Film Ltd.). A pigment ink is thus prepared having a pigment concentration of 5% by mass and a dispersant concentration of 3% by mass.

| | |
|---|---|
| Black dispersion liquid as described above | 50 parts |
| Glycerin | 10 parts |
| Tri-ethylene glycol | 10 parts |
| Acetylene glycol-EO adduct | 0.5 parts |
| Ion-exchange water | 25.5 parts |
| (mfg. by Kawaken Fine Chemicals) | |

The results of an investigation by the inventors into the per-color ink differences in scratch resistance for the ink set described above is shown in Table 1. In this investigation, scratch resistance was evaluated by subjectively determining the ease with which the printed ink was damaged when scratched with a fingernail. In the table, a O indicates no damage, and a X indicates that the ink flaked off revealing the white print medium underneath. The print medium used in this investigation was Canon glossy photo paper (product name: "Glossy Photo Paper [Light] LFM-GP421R"). In addition, a comparison with an ink application quantity of 150% was conducted (taking a 100% ink application quantity applied to one dot to be a 4.5 pl dot applied to a square region 1/1200 inches on a side). Printing operation implemented 8-pass multi-pass printing to avoid introducing bias in any of the print regions.

TABLE 1

Table 1. Per-ink scratch resistance

| Ink Type | Scratch Resistance |
|---|---|
| Black | X |
| Cyan | Δ |

TABLE 1-continued

Table 1. Per-ink scratch resistance

| Ink Type | Scratch Resistance |
|---|---|
| Magenta | Δ |
| Yellow | ◎ |

◎ . . . High scratch resistance
Δ . . . Slightly low scratch resistance
X . . . Low scratch resistance From Table 1 it can be seen that among the inks of the ink set of the present embodiment, yellow ink has the highest scratch resistance compared to the other inks. It is thought that the coefficient of friction between a fingernail and the printed surface to which yellow ink is applied is extremely low compared to that of other inks.

Next, the inventors investigated the scratch resistance of green images formed from a secondary color of cyan and yellow. The investigation used the same method as in Table 1 for three types of images that differed in the application order of the cyan and yellow inks. The investigation also conducted a comparison among the three types of images with an ink application quantity of 100% for each color and 200% for both colors cyan and yellow, under the same conditions as the investigation in Table 1. In order to manage the ink application order, two types of specially-configured mask patterns were created. The first is an 8-pass mask pattern that prints 25% of the cyan in each of the first four passes for a total of 100%, and then prints 25% of the yellow in each of the latter four passes for a total of 100%. The other is a mask pattern that reverses the relationship of these two colors. Furthermore, a typical 8-pass mask pattern wherein 12.5% of the yellow and cyan are printed per pass was also prepared. The scratch resistances of the green images printed using the above three mask patterns were then respectively evaluated. The obtained results are shown in Table 2.

TABLE 2

The relationship between scratch resistance and ink application order

| Print Order | Scratch Resistance |
|---|---|
| Cyan, Yellow (simultaneous) | Δ |
| Cyan→Yellow | ◎ |
| Yellow→Cyan | X |

◎ . . . High scratch resistance
Δ . . . Slightly low scratch resistance
X . . . Low scratch resistance From Table 2, it can be seen that, even for the same green image, scratch resistance is superior when yellow ink is applied later. It is thought that this is because the coefficient of friction of the image surface is lowered due to the later application of yellow. In contrast, it is thought that the worsening of scratch resistance due to applying yellow first occurs because the cyan ink applied on top of the yellow ink does not firmly bond to the yellow ink.

In light of the above investigations, the inventors have determined that, when forming secondary colors by mixing yellow ink with another color, increasing the ratio of yellow ink that is applied later than the other color is advantageous in improving the scratch resistance properties of images. However, in configurations where yellow ink is always applied by the last half of scans in order to apply the yellow ink later than other colors as much as possible, bias in nozzle usage frequency and bias in printing ratios among passes occurs more than necessary. It is desirable to alleviate this kind of unnecessarily excessive bias.

To that end, thorough investigation resulted in the finding that in order to improve the scratch resistance properties of an image while suppressing bias in nozzle usage frequency and bias in printing ratios among passes, it is effective to change the one or more scans used to apply the yellow ink from the default only in the case where predetermined condition are satisfied. More specifically, yellow ink was controlled so as to be applied as much as possible by the last half of plural scans or the final scan of the plural scans, but only in the case where another ink in addition to yellow ink is to be applied to the same area (unit pixel) of the print medium. As a result, it was found that increasing the ratio of yellow ink applied later than other inks is advantageous. Hereinafter, embodiments for realizing this characteristic control will be described.

In the present specification, ink whose one or more application scans are changed between the unit pixel satisfying the predetermined condition and the unit pixel not satisfying the predetermined condition is defined as "specific ink." The specific ink is not limited to one type of ink, and may include two or more types of ink. On the other hand, all inks other than the specific ink are defined as "non-specific ink." In the case of the present embodiments, yellow ink corresponds to the "specific ink," and cyan ink, magenta ink, and black ink correspond to the "non-specific ink."

In the present embodiments, yellow ink, being excellent in scratch resistance properties, is given by way of example as the specific ink. However, it should be appreciated that the types of ink that are excellent in scratch resistance properties are not limited to yellow. Cyan, magenta, or other inks may have excellent scratch resistant properties, depending on the components of the ink to be used. In such a case, the cyan or magenta ink that excellent in scratch resistance properties corresponds to the specific ink.

Figure 9:
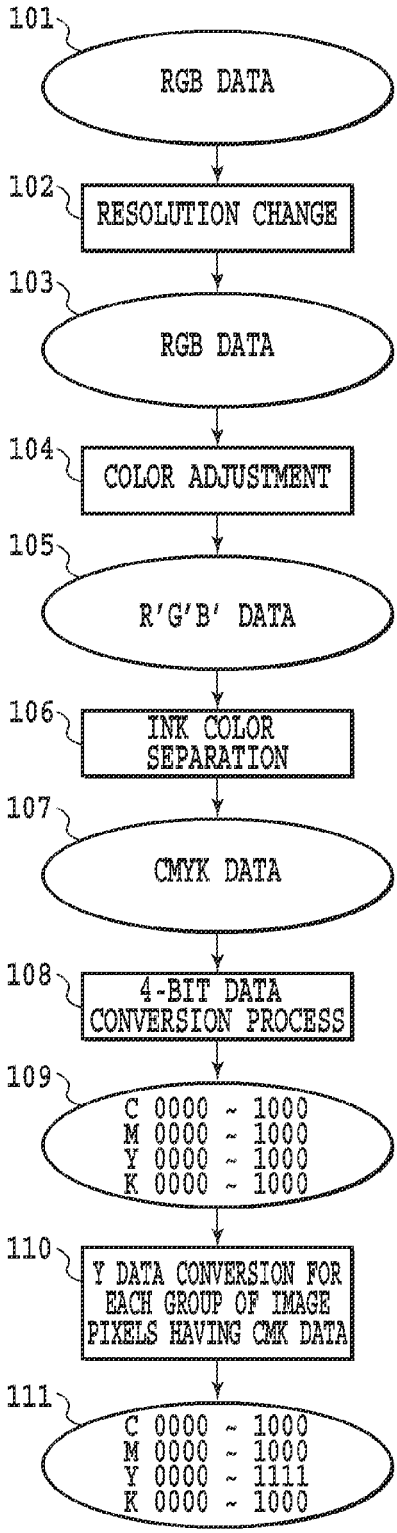
FIG. 9 is a flowchart for concretely describing image processing steps executed in a host device.

FIG. 9 is a flowchart for concretely describing the image processing step executed in a host device of the present embodiment. In the figure, rectangles indicate individual image processing steps, and ovals indicate data transferred between the individual image processing steps.

Typically, a printer driver installed on the host device first receives image data having RGB (red, green, and blue) luminance information 101 from application software or other source. Then, in a resolution change process 102, the image data is converted into RGB data 103 having a resolution suitable for output to the printing apparatus. The resolution at this stage differs from the print resolution (2400 dpi×1200 dpi) at which the printing apparatus ultimately prints dots. In the subsequent color adjustment process 104, the RGB data 103 for each pixel is color adjusted into R'G'B' data 105 suitable for the printing apparatus. This color adjustment process 104 is conducted by referring to a lookup table prepared in advance.

In the ink color separation process 106, the R'G'B' data 105 is converted into CMYK (cyan, magenta, yellow, and black) density data corresponding to the ink colors used in the printing apparatus. Typically, color conversion processing is also conducted by referring to a lookup table. As a concrete example of a conversion method, this process involves replacing the RGB values with their respective CMY complementary colors, while at the same time replacing the portion of no color components with K (black). The data converted into CMYK density data 107 by the ink color separation process 106 is for example 8-bit data having 256 tone levels. In the subsequent 4-bit data conversion processing 108, this data is quantized into multi-valued density data 109 having 9 tone levels and expressed with 4 bits. Multi-value quantization processing such as this can be performed by implementing typical multi-value error diffusion processing. In so doing, 9-level tone data 109 having a value in the range of 0000-1000 for each color is obtained. It should be appreciated that the quantity of ink applied to the unit pixel is ultimately determined based on the density data 107 and the tone data 109. Consequently, this density data 107 and tone data 109 corresponds to the applying amount information on the amount of ink to be applied to a unit pixel. Moreover, the ink color separation process 106 and the 4-bit data conversion process 108, which acquire the density data 107 and the tone data 109, correspond to the process whereby the applying amount information for the unit pixel is obtained.

In the subsequent step 110, a multi-valued pixel (unit pixel) to which yellow ink is to be printed together with another ink other than yellow ink is specified. The yellow data for the corresponding multi-valued pixel specified in this way is then converted into a separate set of yellow data. Herein, the specific ink (yellow) data is converted so as to increase the probability that the specific ink (yellow) will be applied by the last half of the plural scans or the final scan of the plural scans.

Figure 10:
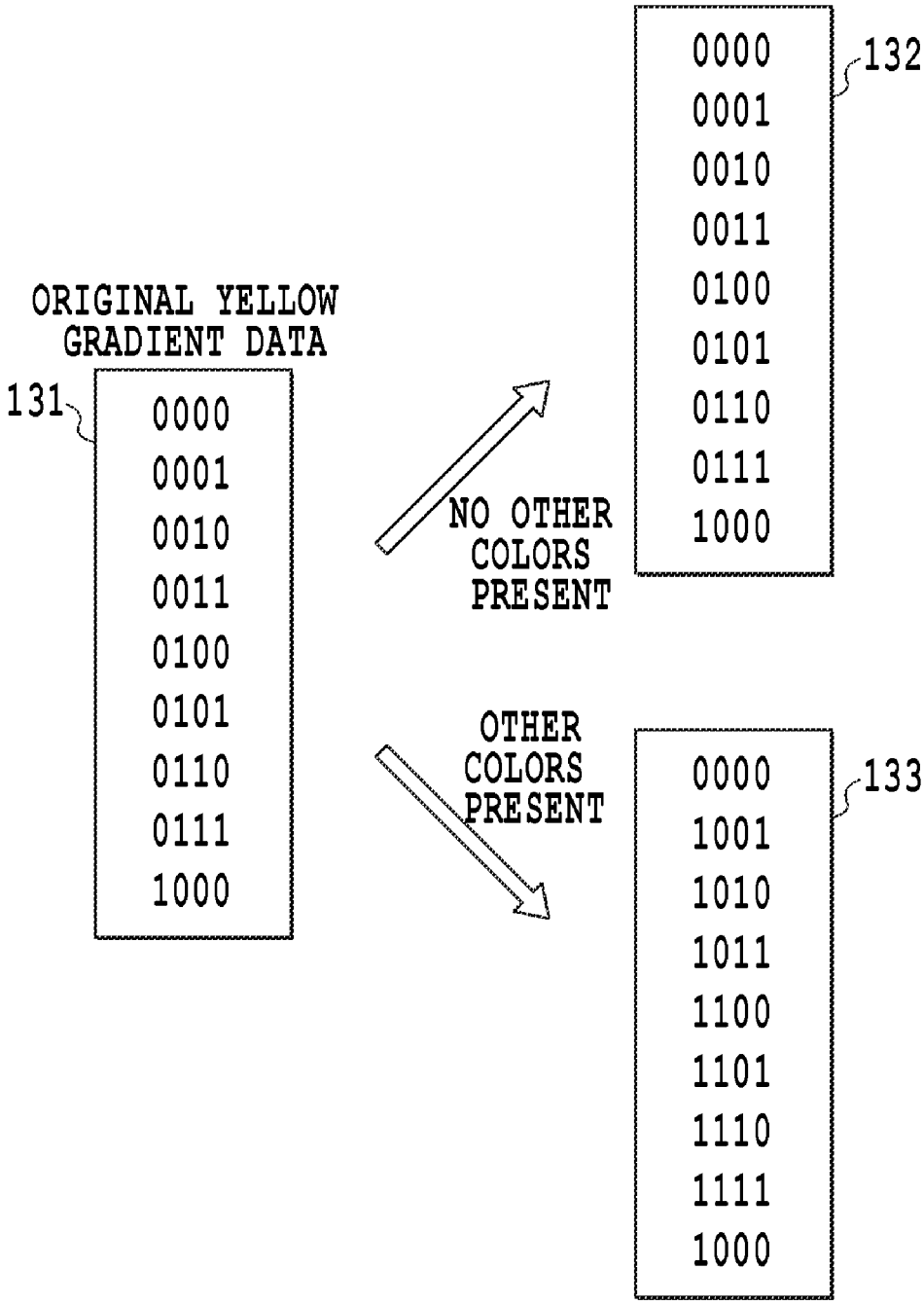
FIG. 10 is a diagram for describing the conversion method for yellow data in the processing step 110.

FIG. 10 is a diagram for describing the conversion method for yellow data in the step 110. Original yellow data 131 is output from the 4-bit data conversion processing step 108, and has 9 values in the range of 0000-1000. For multi-valued pixels having this yellow data, if the cyan, magenta, and black ink tone data are all 0000, yellow data conversion is not conducted, and the original data 131 is output with the values as it is (output data 132). On the other hand, if the cyan, magenta, and black image data are not all 0000 (in other words, if data for at least one color other than yellow is present), the yellow data is converted. Specifically, in this conversion method the most highest-order bit is not converted for yellow data with a value of 0000 or 1000. For other data, i.e., values in the range of 0001-0111, the most highest-order 1 bit is converted from 0 to 1 (output data 133). Referring again to FIG. 9, as a result of conducting the process 110, tone information (111) is output wherein cyan, magenta, and black have 9 values in the range of 0000-1000, and yellow has 16 values in the range of 0000-1111. The lower 3 bits of this yellow tone information becomes information that indicates the number of dots to be printed on individual unit pixels. Meanwhile, as a result of performing the process starting with step 110, the highest-order 1 bit becomes information that specifies the nozzle used to print the dots, as well as the scan used to print the dots.

As described above, the tone information 111 that was subject to the series of image processing steps described in FIG. 9 is output from the host device, and this output tone information 111 is input into the printing apparatus. The tone information 111 input into the printing apparatus is first stored in the receive buffer 307, and then transferred to the frame memory by the system controller 301.

The system controller 301 converts the 4-bit data into 1-bit data for each color using index patterns stored in ROM in advance. This kind of conversion process will be hereinafter referred to as the index patterning process. Hereinafter, the index patterning process will be simply described.

FIG. 19 is a schematic diagram for describing a typical index patterning process. The index patterning process is the process by which multi-level tone data input from a host device or other source is converted into binary data determining whether a dot is to be printed or not printed by the printing apparatus. In the drawing, the tone information 0000-1000 shown on the left side indicates the values of the 4-bit data input from the host device. In the case of the present embodiment, the data at this stage has a resolution of 600 dpi. In the present specification, these pixel units (i.e., pixels having multiple levels of tone values input from the host device) will be hereinafter referred to as unit pixels. Meanwhile, the patterns shown on the right side corresponding to the respective numeric values are the patterns determining whether dots will be actually printed or not printed. Individual squares are arranged at a resolution of 2400 dpi in the main scan direction, and 1200 dpi in the sub-scan direction. In the present specification, these square units (the minimum units determining whether the printing apparatus will actually print or not print a dot) will be hereinafter referred to as pixels. Black indicates pixels for which a dot will be printed, while white indicates pixels for which a dot will not be printed. In other words, in the present embodiment, the region of 1 unit pixel corresponds to the region of a 4×2 group of pixels. From the drawing it can be seen that as the value of the tone data for 1 unit pixel increases, the pixels (black squares) in the 4×2 group of pixels increase by 1.

Figure 20:
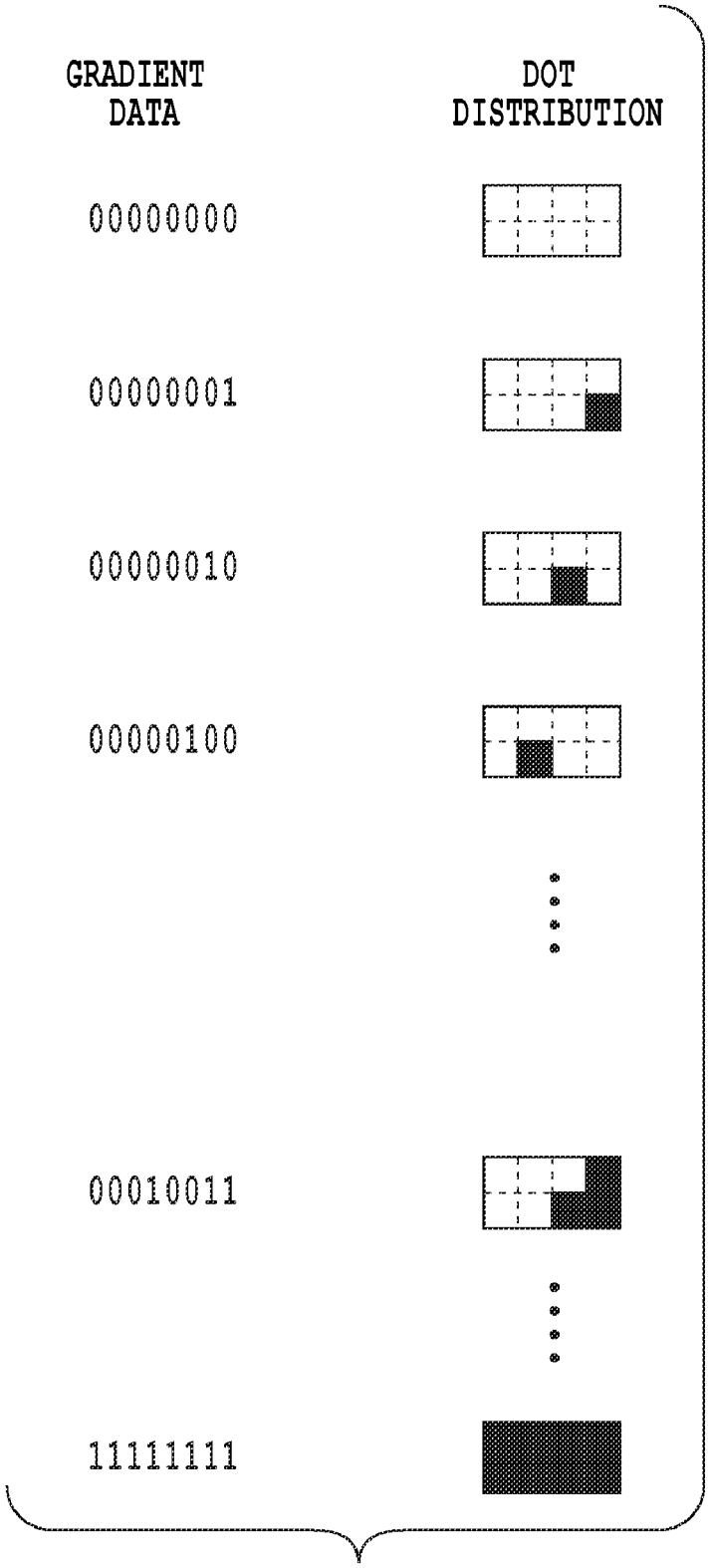
FIG. 20 is a diagram for describing data in the case where 8 print pixels are expressed as printed or not printed using 8 bits.

By implementing an index patterning process such as this, the image processing load in the host device and the amount of data transferred to the printing apparatus from the host device can be decreased. For example, as shown in FIG. 20, 8-bit information is necessary to correctly determine whether a pixel is to be printed or not printed for all of the pixels in the above-described 4×2 group of pixels. In other words, it becomes necessary for the host device to transfer 8-bit information in order to inform the printing apparatus of this region data. However, if index patterns like those shown in FIG. 19 are stored in the printing apparatus in advance, the host device need only transfer the 4-bit information (i.e., the tone data of the unit pixels). As a result, the quantity of data to transfer is reduced by half compared to the case shown in FIG. 20, and thus the transfer speed increases.

Figure 11A:
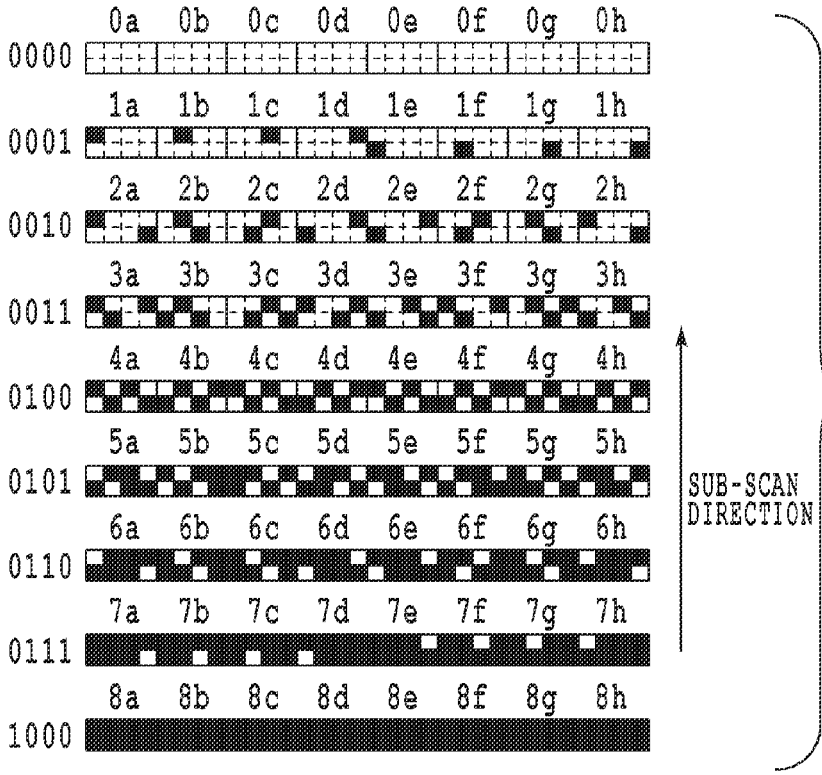
FIGS. 11A and 11B are schematic diagrams for describing index patterns used in the embodiment of the present invention.
Figure 11B:
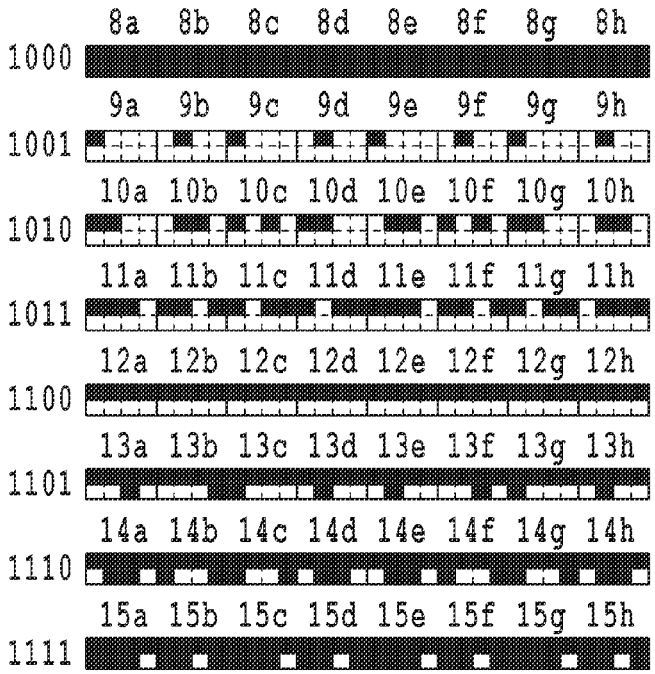

FIGS. 11A and 11B are schematic diagrams describing the index patterns actually used in the present embodiment. In the drawings, the tone information 0000-1111 shown on the left indicates the values of the 4-bit data for each color. In the present embodiment, a plurality of index patterns are prepared corresponding to each of tone data (in this case, 8 patterns each). For example, index patterns 1*a*-1*h* are prepared with respect to the tone information 0001 in FIG. 1A. Although only one of these patterns can be associated with one unit pixel in practice, by preparing in advance a plurality of index patterns such as these, the index patterns can be used in rotation. In other words, even in such cases where similar tone data is consecutively input, a variety of index patterns can be interwoven to dispose dots, and thereby individual nozzle ejection variations and various errors included in the printing apparatus can be made less noticeable in the image. In the present embodiment, the 8 types of index patterns shown in the drawing are used in rotation in the main scan direction. For example, in the case where consecutive unit pixels 0001, 0001, and 0001 are input in the main scan direction, the output patterns become 1*a*, 1*b*, and 1*c*. In addition, in the case where 0001, 0010, and 0001 are input in the main scan direction, the output patterns become 1*a*, 2*b*, and 1*c*.

FIG. 11A shows the index patterns corresponding to the cyan, magenta, and black tone data, as well as the yellow tone data (132) for which conversion was not conducted by the process 110 in FIG. 9. On the other hand, FIG. 11B shows the index patterns corresponding to the yellow output data (133) converted by the process 110. By comparing the drawings it can be seen that for the index patterns in FIG. 11B, a greater number of pixels whereupon dots are to be printed are gathered on the upper row (i.e., the upper row of the two rows of pixels arranged in the sub-scan direction) as compared to the index patterns in FIG. 11A. For example, for 1001 (FIG. 11B), which is converted from 0001 (FIG. 11A), all of the dots are arranged on the upper row. In addition, for 1101 (FIG. 11B), which is converted from 0101 (FIG. 11A), a greater number of dots are arranged on the upper row as compared to 0101. Signal values other than above have the same relationship. In this way, the post-conversion index patterns preferentially print dots on the upper row as compared to the pre-conversion index patterns. The number of dots to be printed within a unit pixel is not increased or decreased by this conversion, and the tone values (information on the number of dots) of the 4-bit data after the conversion process are saved. The present embodiment is configured in this way such that the content of the yellow index pattern is modified only in cases where yellow is to be printed on a unit pixel together with non-yellow. Thus, with this configuration, the advantages of the invention are made obtainable using the relationship with the mask patterns, to be hereinafter described.

When image data is converted by the index patterns, the system controller 301, using the mask patterns stored in the ROM, generates for each print scan dot data to be actually printed by the print heads for each color.

Figure 12:
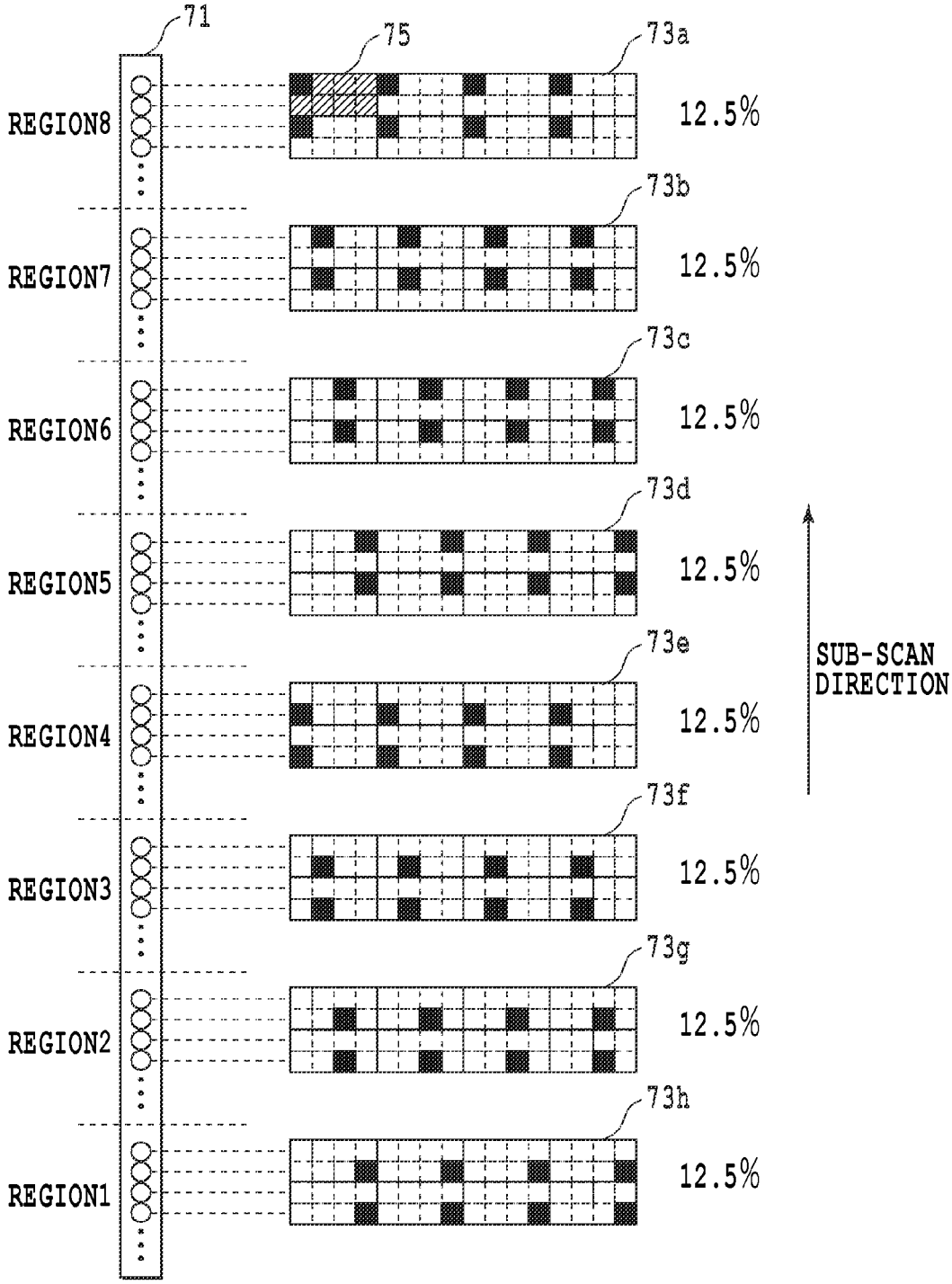
FIG. 12 is a schematic diagram for describing mask patterns for 8-pass multi-pass printing used in the embodiment of the present invention.

FIG. 12 is a schematic diagram for describing the mask patterns for 8-pass multi-pass printing used in the present embodiment. A nozzle row 71 for one color is shown, wherein 1280 individual nozzles (ejection openings) are arranged in the sub-scan direction at a pitch of 1200 dpi. This plurality of nozzles are divided into eight regions, and for these respective regions the mask patterns 73*a*-73*h*, shown in the drawing on the right, are used. Region numbers and pass numbers are associated such that the mask pattern 73*h* corresponding to the region 1 is the mask for the first pass, the mask pattern 73*g* corresponding to the region 2 is the mask for the second pass, and so on. In each mask pattern individual squares indicate single pixels. Black squares indicate pixels for which the printing of dots is permitted, while white squares indicated pixels for which the printing of dots is not permitted, respectively. The mask patterns 73*a*-73*h* of the present embodiment all have permitted equal printing ratios of 12.5%, and furthermore exist in a complementary relationship. In the drawing, mask patterns are shown having 16 pixels in the main scan direction and 4 pixels in the sub-scan direction for the sake of simplicity, but in practical mask patterns have 160 pixels corresponding to each region in the sub-scan direction, and an even larger range in the main scan direction. However, although mask patterns having larger ranges do exist, in the present embodiment a pattern 75, indicated by the shaded region, is used repeatedly in both the horizontal and vertical directions. This repeated region 75 has the same dimensions as the above-described unit pixel region.

When deciding the actual dots to be printed in each print scan, the system controller 301 takes the logical product between the index patterns shown in FIG. 11 and the mask patterns shown in FIG. 12. In so doing, a scan used to print the each dot for each ink color are ultimately determined. In other words, for the non-specific ink (cyan, magenta, black), an index pattern in FIG. 1A is selected based on only the applying amount information for the non-specific ink (i.e., the density data 107 or the tone data 109), and then the one or more scans used to print the non-specific ink dots are determined by taking the AND operation between the selected index pattern and the mask pattern. On the other hand, for the specific ink (yellow), an index pattern in FIG. 11A or FIG. 11B is selected based on the applying amount information for the specific ink (i.e., the density data 107 or the tone data 109) as well as the applying amount information for the non-specific ink (i.e., the density data 107 or the tone data 109), and then the one or more scans used to print the specific ink dots are determined by taking the AND operation between the selected index pattern and the mask pattern. In this way, the dot printing ratio determined for each scan becomes like that shown in FIG. 13.

The result of the logical product taken between an index pattern and a mask pattern will now be concretely described. For the input value 0001 shown in FIG. 11A, for example, the patterns 1*a*-1*h* are repeated in order in the horizontal direction by index rotation. The result of the logical product between these patterns and a mask pattern shown in FIG. 12 is given as follows. For example, the pixels to be printed in the pattern 1*a* match the location of the print permission pixels in the mask pattern 73*a*, and are therefore printed by the region 8. In addition, the pixels to be printed in the pattern 1*b* match the location of the print permission pixels in the mask pattern 73*b*, and are therefore printed by the region 7. Furthermore, when considering in turn patterns 1*c* and 1*d*, it can be seen that the index pattern obtained from the 0001 tone values is divided equally into all regions 1-8 and dots are printed accordingly. Each time a print scan is conducted, the print medium is conveyed in the sub-scan direction as shown in FIG. 12 by an amount corresponding to the width of each region. Consequently, the plurality of dots to be printed in the same image region of the print medium are equally divided and printed by eight print scans corresponding to the eight regions. Similar results are obtained in the same way for all tone values of 0001-1000 shown in FIG. 11A. In this way, the ink applied by the index patterns corresponding to the tone values 0001-1000 shown in FIG. 11A (i.e., the non-specific ink, or alternatively, the specific ink applied singly to a unit pixel) is printed without biasing a specific scan. When the specific ink is printed singly, the application order thereof with respect to the non-specific ink is not an issue, and therefore the index patterns in FIG. 11A are applied, whereby bias in the nozzle usage frequency and bias in the printing ratios among passes can be suppressed.

Next, the tone values of 1001-1111 as shown in FIG. 11B will be described. For the input value of 1001 shown in FIG. 11B, for example, the patterns 9*a*-9*h* are repeated in order in the horizontal direction by index rotation. The result of the logical product taken between these patterns and the mask patterns shown in FIG. 12 is given as follows. For example, the pixels to be printed in the patterns 9*a*, 9*c*, 9*e*, and 9*g* match the location of the print permission pixels in the mask pattern 73*a*, and are therefore printed by the region 8. In addition, the pixels to be printed in the patterns 9*b*, 9*d*, 9*f*, and 9*h* match the location of the print permission pixels in the mask pattern 73*b*, and are therefore printed by the region 7. In other words, for all unit pixels having input values of 1001, 50% of the dots each will be printed either in the seventh pass by the region 7, or in the eighth pass by the region 8. Thus, printing is not conducted for the first through the sixth passes. In this way, the ink applied by the index pattern corresponding to the tone value 1001 shown in FIG. 11B (i.e., the specific ink applied together with non-specific ink to a unit pixel) is printed biasing the later two scans including the final scan. Consequently, for unit pixels to which the specific ink is applied together with the non-specific ink, the ratio of ink applied in the final scan among the plural scans becomes higher for the specific ink than for the non-specific ink.

Furthermore, for the input value of 1010 shown in FIG. 11B, for example, patterns 10*a*-10*h* are repeated in order in the horizontal direction by index rotation. When considering the result of the logical product of these patterns and the mask patterns shown in FIG. 12, it can be seen that the pixels to be print in the patterns 10*a*, 10*d*, and 10*g* match the locations of the print permission pixels in the mask patterns 73*a* and 73*b*, and are therefore printed by the regions 8 and 7. In addition, the patterns 10*b*, 10*e*, and 10*h* match the location of the print permission pixels in the mask patterns 73*b* and 73*c*, and are therefore printed by the regions 7 and 6. Furthermore, the patterns 10*c* and 10*h* match the location of the print permission pixels in the mask patterns 73*a* and 73*c*, and are therefore printed in the regions 8 and 6. In other words, for all the unit pixels having input values of 1010, approximately 33% of the dots will be printed in the sixth pass by the region 6, in the seventh pass by the region 7, and in the eighth pass by the region 8, respectively. Thus, printing is not conducted for the first through the fifth passes. In this way, the ink applied by the index pattern corresponding to the tone value 1010 shown in FIG. 11B (i.e., the specific ink applied to a unit pixel together with non-specific ink) is printed biasing the later three scans. Consequently, for unit pixels to which the specific ink is applied together with non-specific ink, the ratio of ink applied in the last half of the plural scans is greater for the specific ink than for the non-specific ink.

In this way, for input values in the range of 1001-1111, index patterns corresponding to these respective input values are determined such that dots are preferentially printed by the regions 5-8. In other words, for a plurality of scans (8 passes) with respect to a unit pixel, an index pattern is determined such that a greater number of dots are printed by the last half of the plural scans (5th-8th passes), including the final scan (8th pass). For this reason, the specific ink (yellow) whose tone information is converted into 1001-1111 has an increased ratio of dots printed on the print medium later than the other, non-specific ink (cyan, magenta, black). More specifically, the ratio of specific ink applied by the last half of plural scans (5th-8th passes) or the final scan (8th pass) among the specific ink that is applied to a unit pixel by the plural scans (8 passes) becomes greater than the ratio of non-specific ink applied by the last half of plural scans or the final scan among the non-specific ink that is applied to a unit pixel by the plural scans.

Figure 13:
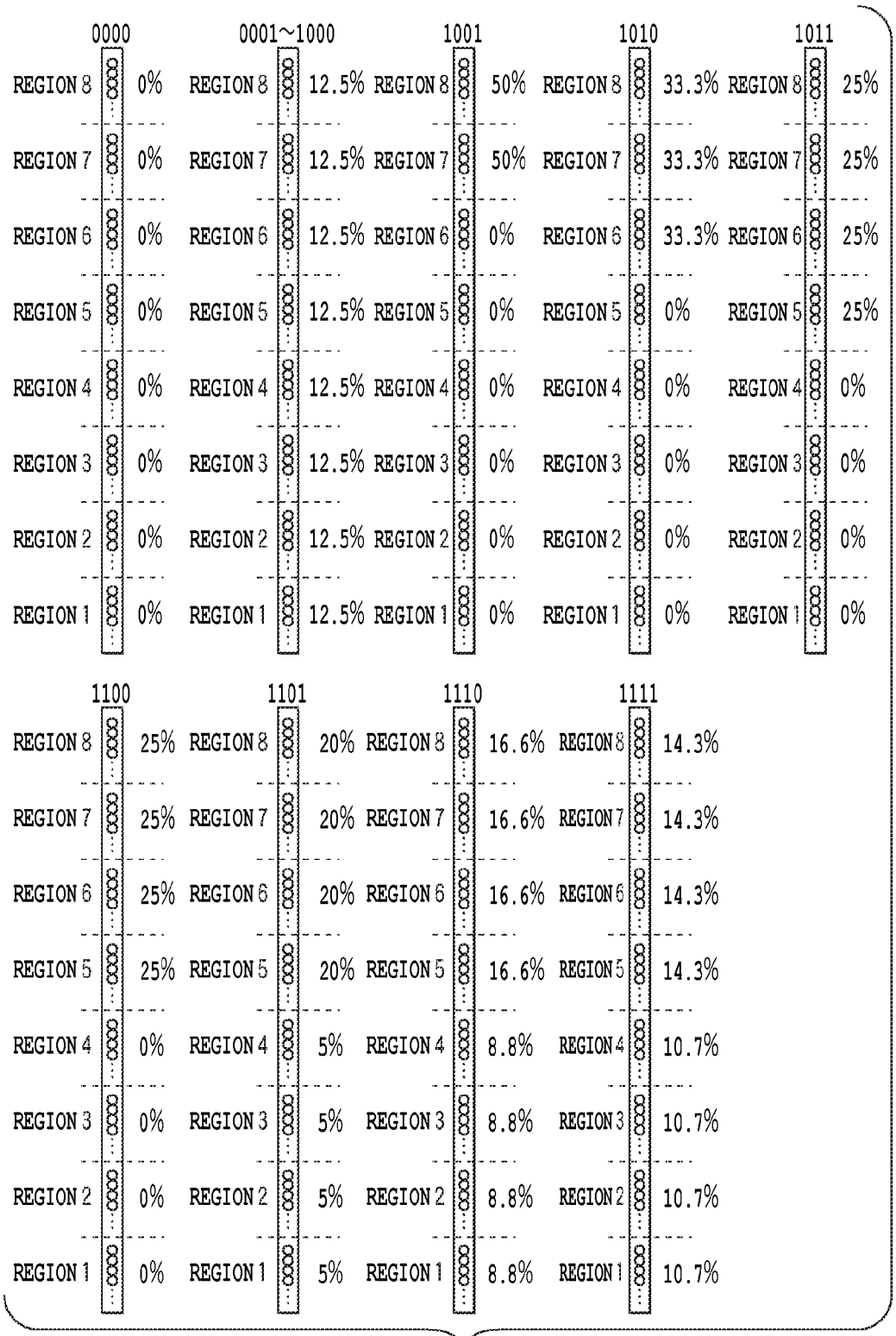
FIG. 13 is a diagram for illustrating the print ratio of dots actually printed by each nozzle region of a print head for tone data 0000-1111.

FIG. 13 is a diagram for illustrating the print ratio of dots actually printed by each print region of the print head versus all dots to be printed for tone data 0000-1111. For 0000-1000, the print ratio is equally distributed over all nozzle regions, and thus the print ratio of each scan is equal. In contrast, for 1001-1111, the print ratio is biased in the regions 5-8, and thus the print ratio is biased toward the last half of scans. In the present embodiment, printing is controlled such that the index patterns 1001-1111 in FIG. 11B are applied for the yellow ink printed overlapping with other color inks in the same region (unit pixel), and thus a large number of yellow dots are applied to the print medium later than the dots of other colors. However, for the yellow ink that is not printed overlapping with other color inks in the same region (unit pixel), printing is controlled such that the index patterns 0001-1000 in FIG. 11A are applied, and thus bias in yellow nozzle usage frequency does not occur.

Table 3 shows the results of the per-ink color dot print ratios in each region of the print head as implemented in the present embodiment. These results were taken when forming an image of 100% printing using the single colors of cyan, magenta, yellow, and black, as well as secondary colors thereof. In the table, 100% printing of a primary color refers to the state wherein dots of the same color were printed one by one on all of the 4×2 pixels contained in one unit pixel. In addition, 100% printing of a secondary color refers to the state wherein different colors of four dots each were respectively printed on the 4×2 pixels contained in one unit pixel. According to the table, it can be seen that the print ratio for the single color yellow is 12.5% in all regions 1-8, while for the case wherein yellow is combined with another color to print colors such as green or red, yellow is printed at 25% each, divided into the regions 5-8.

TABLE 3

| Nozzle usage ratio according to input image | | | | | | | | | |
|---|---|---|---|---|---|---|---|---|---|
| Input | | Dot print ratio by region | | | | | | | |
| Image | Ink | Region 1 | Region 2 | Region 3 | Region 4 | Region 5 | Region 6 | Region 7 | Region 8 |
| Cyan | Cyan | 12.50% | 12.50% | 12.50% | 12.50% | 12.50% | 12.50% | 12.50% | 12.50% |
| | Magenta | 0.00% | 0.00% | 0.00% | 0.00% | 0.00% | 0.00% | 0.00% | 0.00% |
| | Yellow | 0.00% | 0.00% | 0.00% | 0.00% | 0.00% | 0.00% | 0.00% | 0.00% |
| | Black | 0.00% | 0.00% | 0.00% | 0.00% | 0.00% | 0.00% | 0.00% | 0.00% |
| Yellow | Cyan | 0.00% | 0.00% | 0.00% | 0.00% | 0.00% | 0.00% | 0.00% | 0.00% |
| | Magenta | 0.00% | 0.00% | 0.00% | 0.00% | 0.00% | 0.00% | 0.00% | 0.00% |
| | Yellow | 12.50% | 12.50% | 12.50% | 12.50% | 12.50% | 12.50% | 12.50% | 12.50% |
| | Black | 0.00% | 0.00% | 0.00% | 0.00% | 0.00% | 0.00% | 0.00% | 0.00% |
| Red | Cyan | 0.00% | 0.00% | 0.00% | 0.00% | 0.00% | 0.00% | 0.00% | 0.00% |
| | Magenta | 12.50% | 12.50% | 12.50% | 12.50% | 12.50% | 12.50% | 12.50% | 12.50% |
| | Yellow | 0.00% | 0.00% | 0.00% | 0.00% | 25.00% | 25.00% | 25.00% | 25.00% |
| | Black | 0.00% | 0.00% | 0.00% | 0.00% | 0.00% | 0.00% | 0.00% | 0.00% |
| Green | Cyan | 12.50% | 12.50% | 12.50% | 12.50% | 12.50% | 12.50% | 12.50% | 12.50% |
| | Magenta | 0.00% | 0.00% | 0.00% | 0.00% | 0.00% | 0.00% | 0.00% | 0.00% |
| | Yellow | 0.00% | 0.00% | 0.00% | 0.00% | 25.00% | 25.00% | 25.00% | 25.00% |
| | Black | 0.00% | 0.00% | 0.00% | 0.00% | 0.00% | 0.00% | 0.00% | 0.00% |
| Blue | Cyan | 12.50% | 12.50% | 12.50% | 12.50% | 12.50% | 12.50% | 12.50% | 12.50% |
| | Magenta | 12.50% | 12.50% | 12.50% | 12.50% | 12.50% | 12.50% | 12.50% | 12.50% |
| | Yellow | 0.00% | 0.00% | 0.00% | 0.00% | 0.00% | 0.00% | 0.00% | 0.00% |
| | Black | 0.00% | 0.00% | 0.00% | 0.00% | 0.00% | 0.00% | 0.00% | 0.00% |
| Black | Cyan | 0.00% | 0.00% | 0.00% | 0.00% | 0.00% | 0.00% | 0.00% | 0.00% |
| | Magenta | 0.00% | 0.00% | 0.00% | 0.00% | 0.00% | 0.00% | 0.00% | 0.00% |
| | Yellow | 0.00% | 0.00% | 0.00% | 0.00% | 0.00% | 0.00% | 0.00% | 0.00% |
| | Black | 12.50% | 12.50% | 12.50% | 12.50% | 12.50% | 12.50% | 12.50% | 12.50% |

As described in the foregoing, as a result of the present embodiment, when a specific ink is to be applied to a unit pixel, the one or more scans used to apply the specific ink are determined according to application conditions of the non-specific ink (applying amount information). More specifically, a unit pixel to which the specific ink is to be applied together with the non-specific ink (i.e., the unit pixel that satisfies the predetermined condition) is specified based on the applying amount information for the specific ink and the non-specific ink. Subsequently, one or more scans used to apply the specific ink are determined such that the ratio of specific ink applied by the last half of plural scans or the final scan of the plural scans is greater for this unit pixel that satisfies the above predetermined condition than for a unit pixel that does not satisfy the predetermined condition. In so doing, the ratio of specific ink applied by the last half of the plural scans or the final scan of the plural scans increases for the unit pixels to which the specific ink is to be applied together with the non-specific ink, and thus the probability increases that the specific ink will be applied by a later scan than the non-specific ink. As a result, the specific ink, being excellent in scratch resistance properties, can be applied later than the other, non-specific ink, and the scratch resistance properties of the image can be improved.

Second Embodiment

Hereinafter, a second embodiment of the present invention will be described. In this embodiment, the inkjet printing system and the image processing methods shown in FIGS. 6-11B are applied similarly as in the first embodiment. However, the second embodiment differs from the first embodiment in that mask patterns for executing 16-pass multi-pass printing are prepared.

Figure 14:
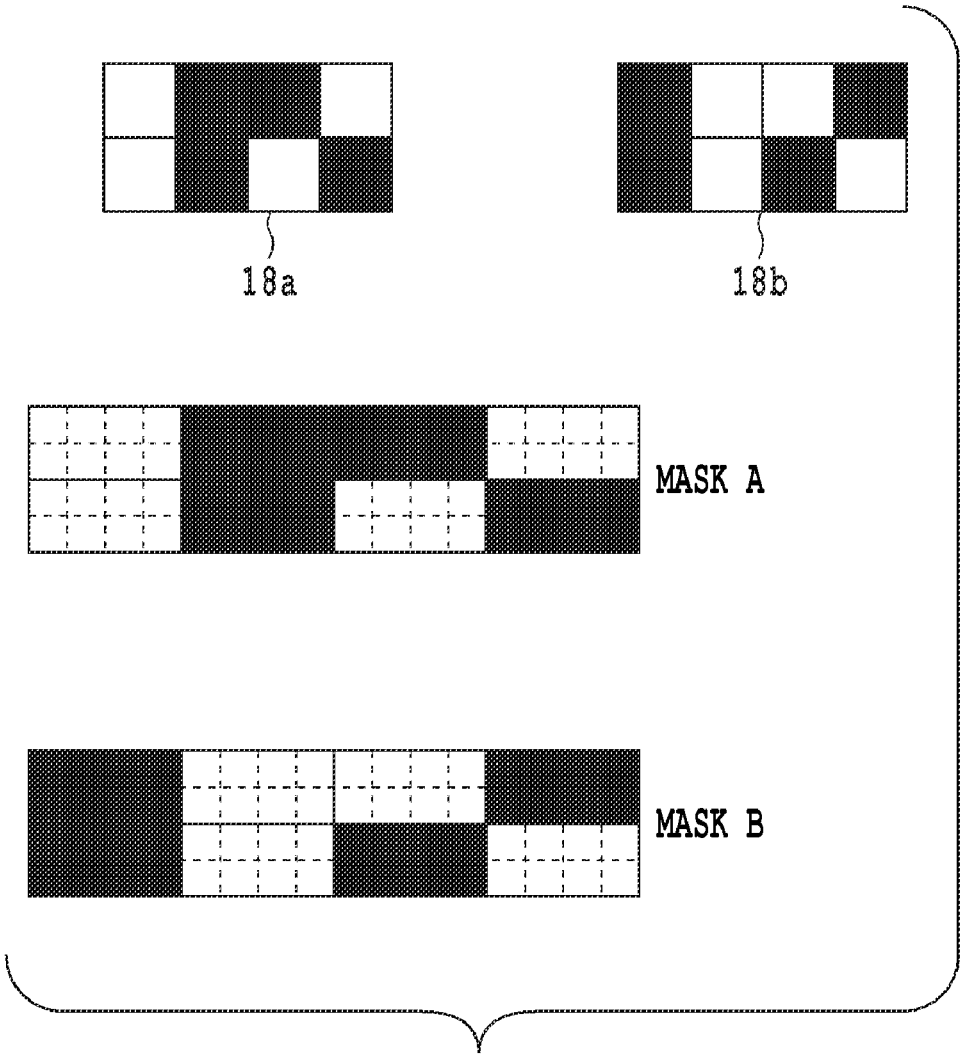
FIG. 14 is a diagram for illustrating new mask patterns used to create mask patterns which is applied in the second embodiment of the present invention.

FIG. 14 is a diagram for illustrating new mask patterns used to create the mask patterns applied in the present embodiment. The two types of mask patterns 18*a* and 18*b* exist in a complementary relationship. Areas indicated in black are the print permission areas, while areas indicated in white are the print non-permission areas. A narrow 4-area by 2-area region is shown herein, but the distribution of the permission areas is irregular. In other words, print permission and non-permission are determined randomly.

Mask A and mask B are mask patterns that exist in a complementary relationship and were created by enlarging the above-described masks 18*a* and 18*b* into a 2-area (vertical) by 4-area (horizontal) region. In the present embodiment, the respective logical products of the masks A and B created in this way with the eight mask patterns 73*a*-73*h* used in the first embodiment are taken, and the obtained results are taken as 16 new mask patterns.

Figure 15:
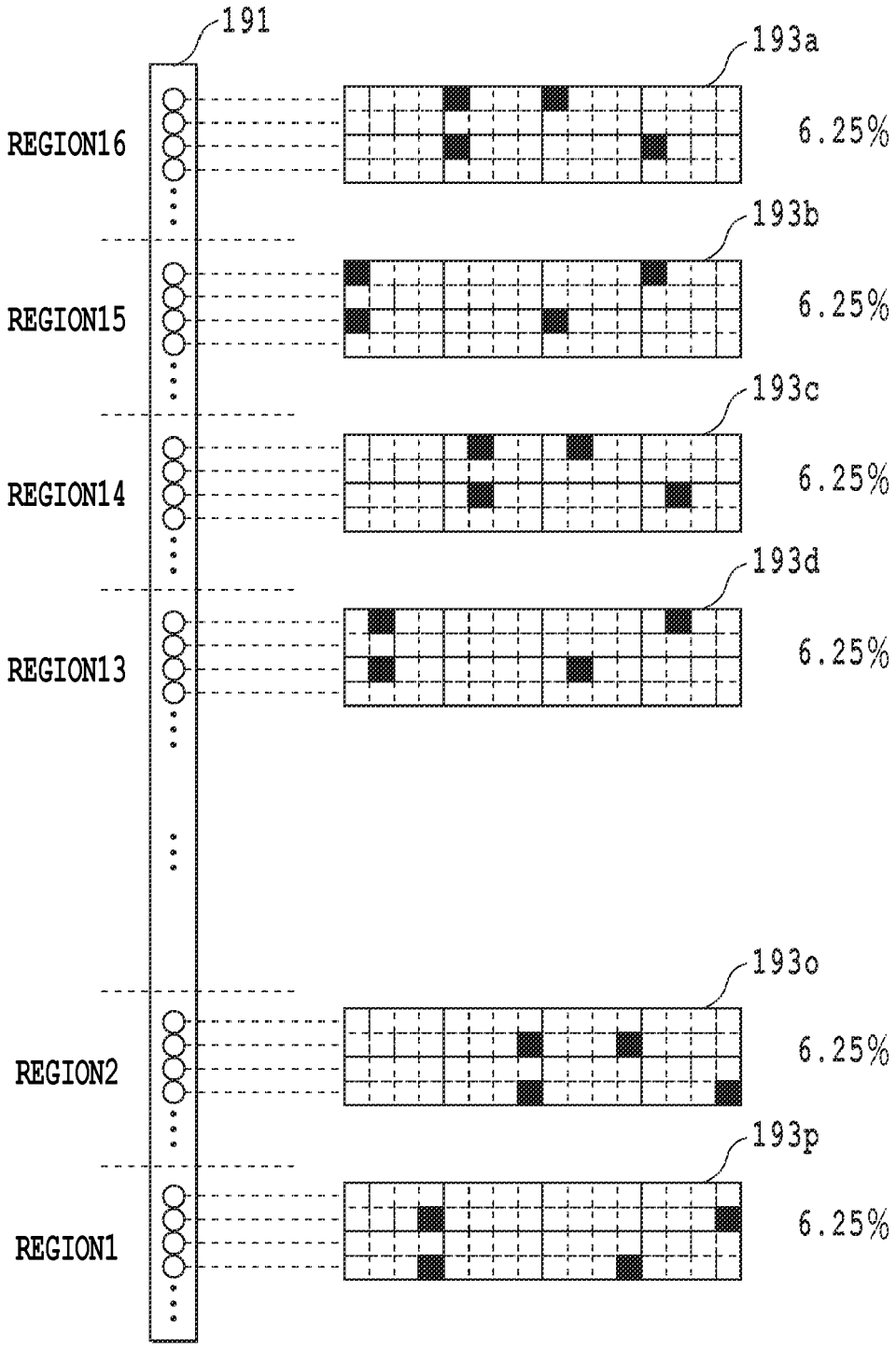
FIG. 15 is a diagram for illustrating the mask patterns used in the second embodiment of the present invention.

FIG. 15 is a diagram for describing the mask patterns of the present embodiment created in this way. Since 16-pass multi-pass printing is conducted, the 1280 nozzles of the nozzle row are divided into 16 regions, each region containing 80 nozzles. Specifically, the mask patterns corresponding to each of the regions are as follows. The result obtained by taking the logical product of the mask pattern 73*a* and the mask A is taken to be mask pattern 193*a* for the region 16. In addition, the result obtained by taking the logical product of the mask pattern 73*a* and the mask B is taken to be mask pattern 193*b* for the region 15. Furthermore, the result of the mask pattern 73*b* and the mask A is mask pattern 193*c* for the region 14, the result of the mask pattern 73*b* and the mask B is mask pattern 193*d* for the region 13, etc. The mask patterns for each region are thus determined in this order. The print permission ratio is equally 6.25% for each mask pattern.

By creating mask patterns in this way, similar advantages to those of the first embodiment can be obtained in the second embodiment as well. This is because the print permission pixels for the regions 5-8 shown in FIG. 12 are distributed among the upper half of the regions (regions 9-16) of the print head in FIG. 15, and thus the dots are printed in the latter half of the print scans (the ninth pass through the sixteenth pass). Furthermore, since the present embodiment includes the additional characteristic that the mask patterns are random, the print permission pixels in each region are distributed more irregularly compared to those of FIG. 12, as can be seen from FIG. 15. Consequently, since the nozzles that actually print the dots are optimally distributed, even for the case where image data having regularity is printed, the advantages of multi-pass printing can be expected to significantly improve. As a result, it is possible to print even further smoother images without threading or banding compared to the first embodiment.

Although the foregoing was described using the random masks 18*a* and 18*b*, which have narrow 4-area by 2-area regions, it should be appreciated that in practice mask patterns having even larger regions may be used. In this case, the distribution of the print permission pixels for the entire mask pattern region may be determined randomly, or alternatively, mask patterns using a repetition of the above 4-area by 2-area region may be used.

As described above, in the present embodiment, by using a random mask pattern which exhibits no bias in print ratio for any color or region, the scratch resistance properties of the image can be improved.

Third Embodiment

Hereinafter, a third embodiment of the present invention will be described. In this embodiment, the inkjet printing system and the image processing methods shown in FIGS. 6-9 are applied similarly as in the foregoing embodiments. However, the mask patterns and the index patterns of the third embodiment differ from the foregoing embodiments in that they are disposed in rotation while maintaining a synchronized relationship.

Figure 16:
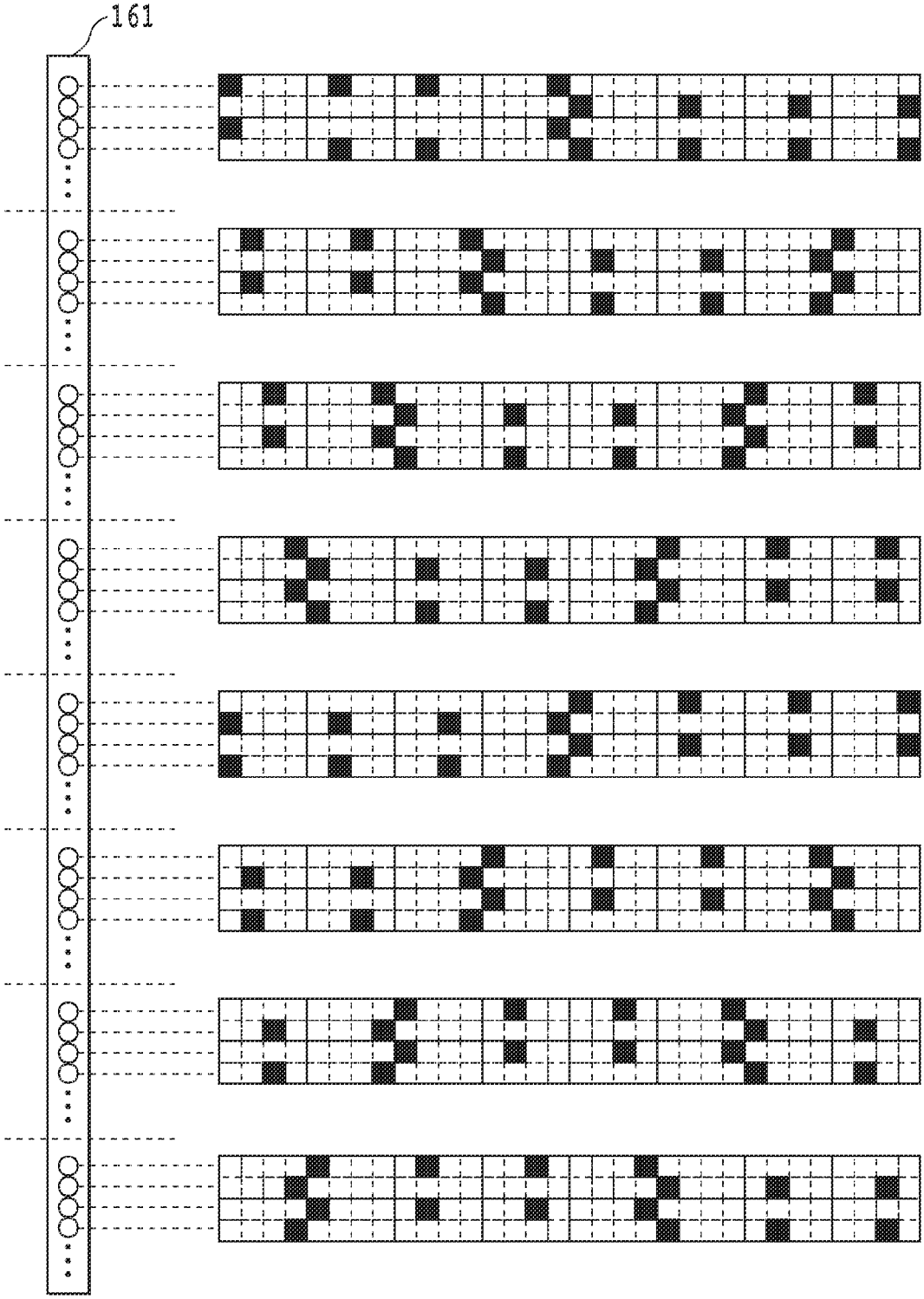
FIG. 16 is a schematic diagram for illustrating the mask patterns applied in the third embodiment of the present invention.

FIG. 16 is a schematic diagram for describing the mask patterns applied in the present embodiment. The mask patterns in the present embodiment are not formed by repeating the repeating patterns shown in FIG. 12 along the main scan direction, but instead by disposing in order the respective repeating patterns used in the regions 1-8 along the main scan direction. In this way, even when using the repeating patterns in rotation, the regions 1-8 maintain a complementary relationship.

However, if index patterns similar to those of the first embodiment are used with the mask patterns used in a rotation such as this, it becomes impossible to print the pixels determined to be printed by the index patterns with the desired regions of the print head. Consequently, in the present embodiment, both the index patterns and the mask patterns are used in a synchronized rotation.

Figure 17:
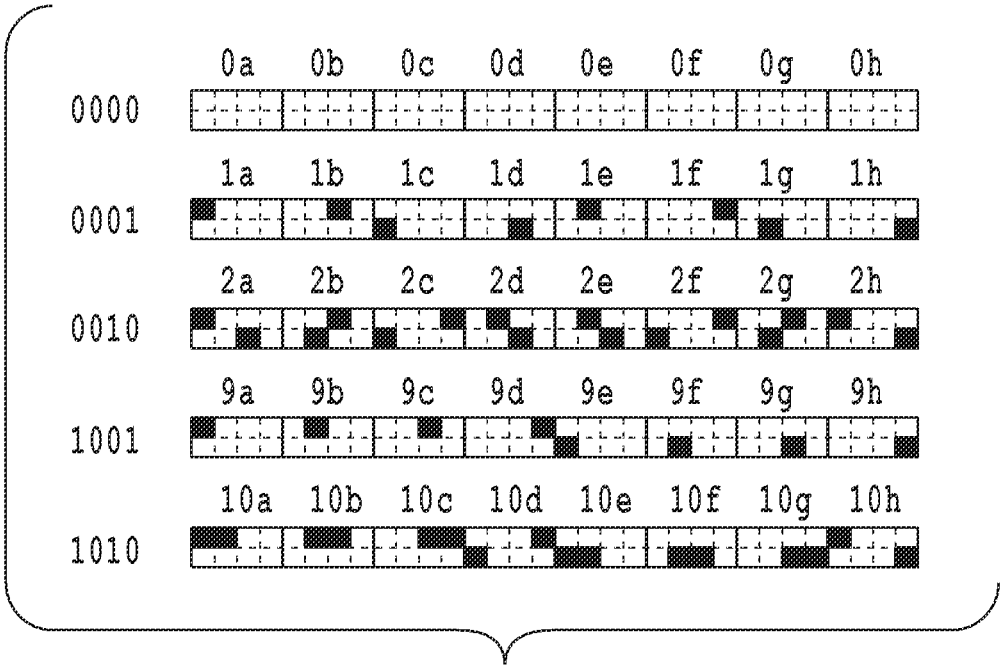
FIG. 17 is a schematic diagram for illustrating the index patterns used for a portion of tone data in the third embodiment of the present invention.

FIG. 17 is a schematic diagram for showing the index patterns used in the present embodiment for the portions of the tone data 0001, 0010, 1001, and 1010. For example, the index patterns 1*a*-1*h* prepared for use with the tone data 0001 differ from the index patterns prepared for use with the tone data 0001 of the first embodiment (in other words, the index patterns 1*a*-1*h* in FIG. 11A). In addition, the index patterns prepared for use with the tone data 1001 also differ from the index patterns 9*a*-9*h* in FIG. 11B. However, by using these index patterns together with the mask patterns in a rotation as shown in FIG. 16, similar advantages to those of the first embodiment can be obtained in the present embodiment. In other words, while the print data for single-color yellow is distributed equally among the first through the eighth passes, print data for yellow included in mixed-color images is printed concentrated in the fifth through the eighth passes. However, the present invention is not to be defined by the respective characteristics of the index patterns and the mask patterns. Rather, it is the characteristic that the regions (pass numbers) where dots are actually printed are controlled by deliberately correlating the index patterns and the mask patterns. When the index patterns used in the present embodiment (FIG. 17) are compared to the index patterns used in the first embodiment (FIGS. 11A and 11B), it can be seen that, even for the same tone data, the nozzles used are more effectively distributed in the present embodiment. In other words, smoother output images can be expected from the present embodiment.

Fourth Embodiment

Hereinafter, a fourth embodiment of the present invention will be described. In this embodiment, the inkjet printing system shown in FIGS. 6-8 is applied similarly as in the foregoing embodiments. In addition, index patterns and mask patterns similar to those of the first embodiment shown in FIGS. 11A, 11B, and 12 are used. Furthermore, this embodiment is similar to the first embodiment in that, for a unit pixel to which the specific ink is to be applied, the one or more scans used to apply the specific ink are determined according to the application conditions (applying amount information) of the non-specific ink. However, in the present embodiment, the image processing steps are made to differ from those of the above first embodiment. More specifically, the index pattern selection method and the conditions whereby the one or more scans used to apply the specific ink are determined are made to differ.

Figure 21:
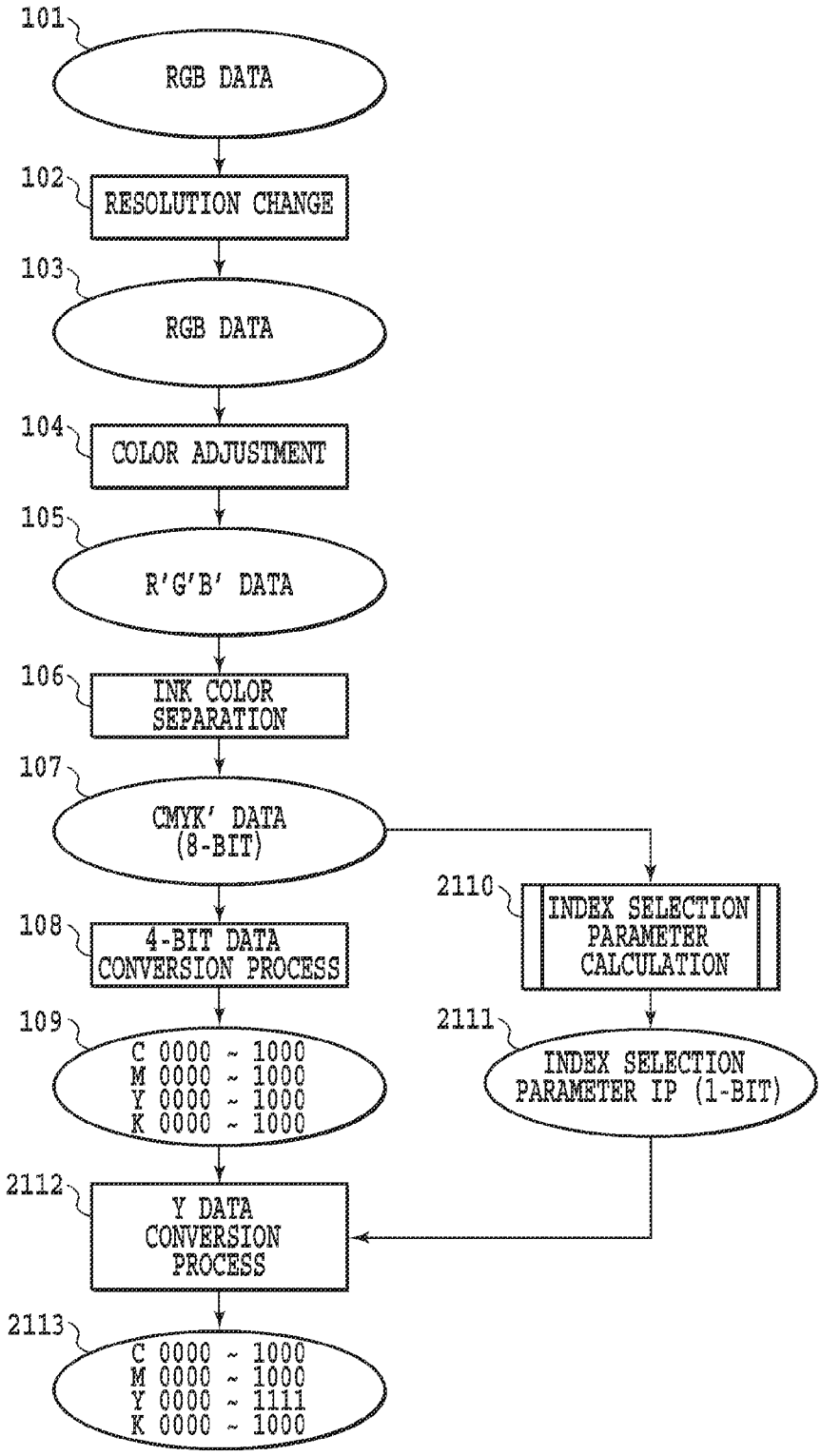
FIG. 21 is a flowchart for concretely describing the image processing steps executed in a host device used in the fourth embodiment of the present invention.

FIG. 21 is a flowchart for describing the image processing steps of the present embodiment in comparison with those of FIG. 9. The processing steps/data 101-107 are identical to those described in FIG. 9. In the present embodiment, the 8-bit CMYK density data 107 obtained by the ink color separation process 106 is sent to the 4-bit data conversion processing step 108, as in the first embodiment. However, at the same time this data 107 is also sent to an index selection parameter calculation processing step 2110, characteristic of the present embodiment. In the present embodiment, the density data 107 corresponds to the applying amount information that is related to the quantity of ink to be applied to a unit pixel.

In the present embodiment, during the index selection parameter calculation process 2110, the four-color CMYK density data 107 is referenced in order to compute a 1-bit index selection parameter IP 2111, the parameter having information of either 0 or 1. More specifically, a unit pixel having an application ratio of CMK ink to Y ink that is greater than a predetermined ratio (i.e., a unit pixel satisfying the predetermined condition) is specified based on the density data 107 (ink applying amount information) of the unit pixel. The index selection parameter IP becomes "1" for a unit pixel specified in this way. In contrast, the index selection parameter IP becomes "0" for a unit pixel whose application ratio of non-specific ink to specific ink is lower than the predetermined ratio (i.e., the unit pixel that doesn't satisfy the predetermined condition). When the index selection parameter IP is "1", the ratio of yellow ink that is used by the last half of the plural scans or the final scan of the plural scans becomes greater than that of the case where the index selection parameter IP is "0".

Figure 22:
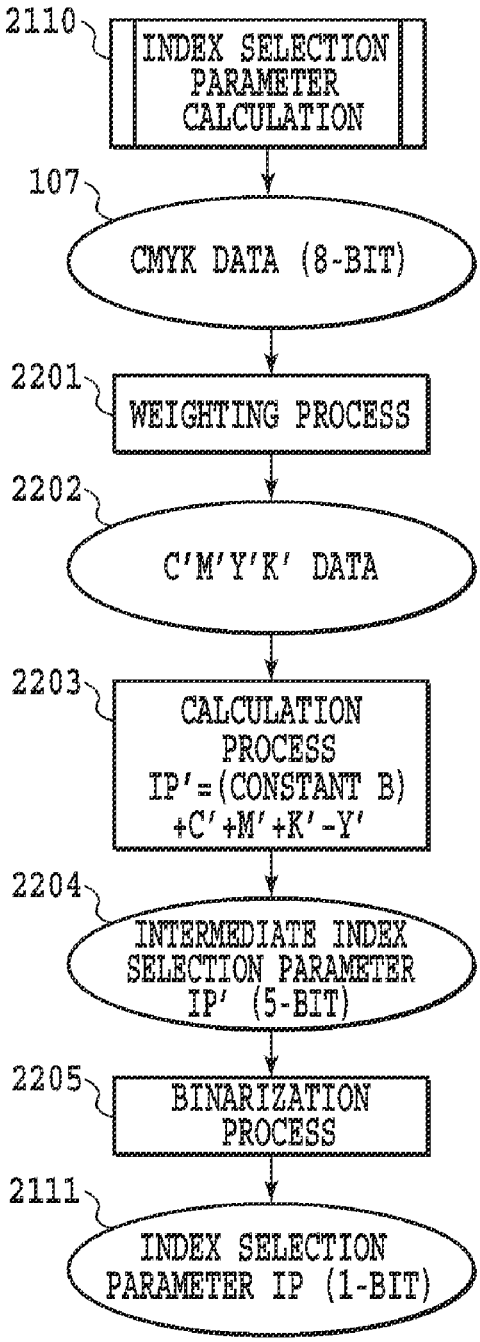
FIG. 22 is a diagram for concretely describing the process by which an index selection parameter is calculated, the parameter being used in the fourth embodiment of the present invention.

FIG. 22 is a flowchart for describing the calculation process in the index selection parameter calculation process 2110. In this process, the CMYK density data 107 is first subject to a weighting process 2201, wherein the data 107 is multiplied by a predetermined weighting coefficient having a value in the range of 0-1, and wherein any fractional values generated thereby are truncated. In so doing, new density data C'M'Y'K' 2202 is obtained.

In the subsequent processing step 2203, an intermediate index selection parameter IP' 2204 is computed using a constant B prepared in advance. This parameter is given as IP'=C'+M'+K'−Y'+B, and is computed as 5-bit (32 values) data, the last 3 bits having been truncated.

Table 4 shows an example of per-color 256-tone (8-bit) CMYK density data 107 input into the index selection parameter calculation process 2110, as well as the converted values of these data given by the weighting process 2201 and the calculation process 2203. In this example, the weighting coefficient for C, M, and K is 0.16, the weighting coefficient for Y is 0.5, and the constant B is 128. Referring to the table, it can be seen that when the Y density value is low compared to the other colors, the intermediate index selection parameter IP' becomes a comparatively large value. When the Y density value is high compared to the other colors, the intermediate index selection parameter IP' becomes a comparatively small value. If the intermediate index selection parameter IP' is a large value, the probability increases that the index selection parameter IP 2111 will become 1. In other words, the probability increases that yellow ink (i.e., the specific ink) will be applied by the last half of the plural scans or the final scan of the plural scans. In contrast, if the intermediate index selection parameter IP' is a small value, the probability increases that the index selection parameter IP 2111 will become 0.

TABLE 4

| | | Density data | Weighting coefficient | Weighting calculation result | Calculation constant B | Post-calculation process value | IP' after last 3 bits are truncated |
|---|---|---|---|---|---|---|---|
| Data | C | 255 | C 0.16 | 40 | 128 | 238 | 29 |
| Example 1 | M | 255 | M 0.16 | 40 | | | |
| | Y | 20 | Y 0.5 | 10 | | | |
| | K | 255 | K 0.16 | 40 | | | |
| Data | C | 20 | | 3 | | 132 | 16 |
| Example 2 | M | 20 | | 3 | | | |
| | Y | 20 | | 10 | | | |
| | K | 50 | | 8 | | | |
| Data | C | 0 | | 0 | | 1 | 0 |
| Example 3 | M | 0 | | 0 | | | |
| | Y | 255 | | 127 | | | |
| | K | 0 | | 0 | | | |

Upon computing the intermediate index selection parameter IP' 2204 as above, a binarization process 2205 is furthermore performed on this value, thereby converting the intermediate index selection parameter IP' into a 1-bit (2 values) index selection parameter IP 2111. In this case, typical error diffusion or dither methods may be implemented as the binarization process method.

Referring again to the flowchart in FIG. 21, in the present embodiment, the 4-bit CMYK data 109 obtained from the 4-bit data conversion process 108, as well as the 1-bit index selection parameter IP 2111 obtained from the index selection parameter calculation process 2110, are input into the Y data conversion process 2112. The Y data conversion process 2112 converts the 4-bit yellow data into new 4-bit data according to the value of the index selection parameter IP. Specifically, in the case where the yellow data 109 is 0000 or 1000, and wherein furthermore the index selection parameter IP 2111 is 0, signal value conversion is not conducted. In other words, for unit pixels to which yellow ink is to be applied singly, or unit pixels having an application ratio of ink other than yellow to yellow ink that is lower than a predetermined ratio, the index patterns in FIG. 11A are applied. Since application order with respect to other ink is not an issue for unit pixels to which yellow ink is to be applied singly, an index pattern advantageous in suppressing bias in nozzle usage frequency is applied. In addition, for unit pixels wherein the application ratio of ink other than yellow to yellow ink is lower than a predetermined ratio, it is already likely that yellow ink will be applied later than the ink for other colors without applying any special control, and thus an index pattern advantageous in suppressing bias in nozzle usage frequency is applied. Going through the Y data conversion process 2112 like the above results in cyan, magenta, and black yielding tone information (2113) having 9 values in the range 0000-1000, while yellow yields tone information (2113) having 16 values in the range 0000-1111. In the tone information 2113, the lower 3 bits becomes information indicating the number of dots to be printed on individual unit pixels. On the other hand, by performing the following processing, the highest-order bit ultimately becomes information specifying the nozzle positions whereby the dots are to be printed, as well as the scan used to print the dots.

By implementing a method such as the above, in the present embodiment, it becomes possible to gradually change the index patterns for yellow ink according to the print ratio of the other colors. For example, in the first embodiment, for the case where data for the colors other than yellow is very small, the print ratios will be uniformly configured like those shown in FIG. 13, despite of there being almost no problems regarding scratch resistance. In contrast, in the present embodiment, the yellow print ratio can be set to be approximately equal for every region of the print head. In other words, in the present embodiment, it is possible to sufficiently realize the advantages of multi-pass printing without introducing bias in the print ratios for each region of the print head more than necessary.

In the foregoing description, the calculation process as described in the flowchart in FIG. 22 was conducted for all unit pixels. However, as long as the relationship between the CMYK input values and the IP' output value is unambiguously fixed like that shown by way of example in Table 4, the invention may be configured to determine the intermediate index selection parameter IP' by referencing such a lookup table prepared in advance. In addition, in the present embodiment it was described by way of example that according to the ratio of non-specific to specific ink, the unit pixels to which the index patterns in FIG. 11B are applied gradually increase. However, when this ratio exceeds a determined value, the ratio of specific ink used by the last half of plural scans or the final scan of the plural scans may also be unambiguously increased.

As a result of the above-described embodiment, a unit pixel having an application ratio of non-specific ink to specific ink that is higher than a predetermined ratio (i.e., the unit pixel that satisfies the predetermined condition) is specified based on the applying amount information for the specific ink and the non-specific ink. Subsequently, one or more scans used to apply the specific ink are determined such that the ratio of specific ink to be applied by the last half of plural scans or the final scan of the plural scans becomes greater for a unit pixel that satisfies the above predetermined condition than for a unit pixel that does not satisfy the predetermined condition. In so doing, the ratio of specific ink printed by the last half of plural scans or the final scan of the plural scans increases for the unit pixels having an application ratio of non-specific ink to specific ink that is higher than a predetermined ratio, and ultimately the probability increases that the specific ink will be applied by a scan later than the non-specific ink. As a result, the specific ink, being excellent in scratch resistance properties, can be applied later than the other non-specific inks, and thus the scratch resistance properties of the image can be improved.

Fifth Embodiment

Hereinafter, a fifth embodiment of the present invention will be described. In this embodiment, the inkjet printing system as shown in FIGS. 6-8 is applied similarly as in the foregoing embodiments.

Figure 23:
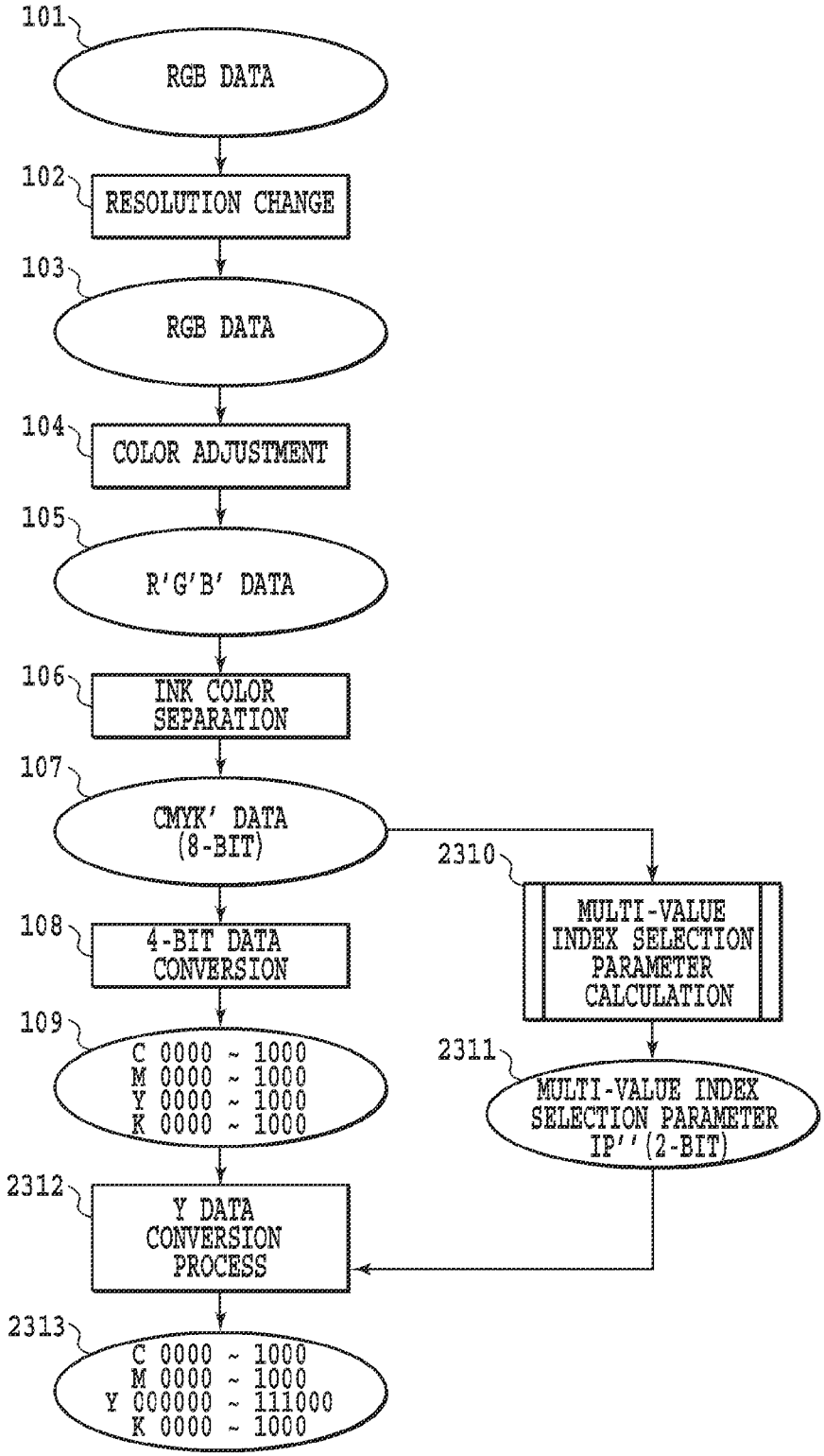
FIG. 23 is a flowchart for concretely describing the image processing steps executed in a host device and used in the fifth embodiment of the present invention.

FIG. 23 is a flowchart for describing the image processing procedure of the present embodiment in comparison with those in FIGS. 9 and 21. The processing steps/data 101-107 are identical to those described in FIGS. 9 and 21. In the present embodiment, the 8-bit CMYK density data 107 obtained by the ink color separation process 106 is also sent to the 4-bit data conversion processing step 108, as in the foregoing embodiments. However, at the same time this data 107 is also sent to a multi-value index selection parameter calculation process 2310, characteristic of the present embodiment.

In the present embodiment, during the multi-value index selection parameter calculation process 2310, the four-color CMYK density data 107 is referenced in order to calculate an index selection parameter IP" 2311 which is consisting 2-bit four values data.

Figure 24:
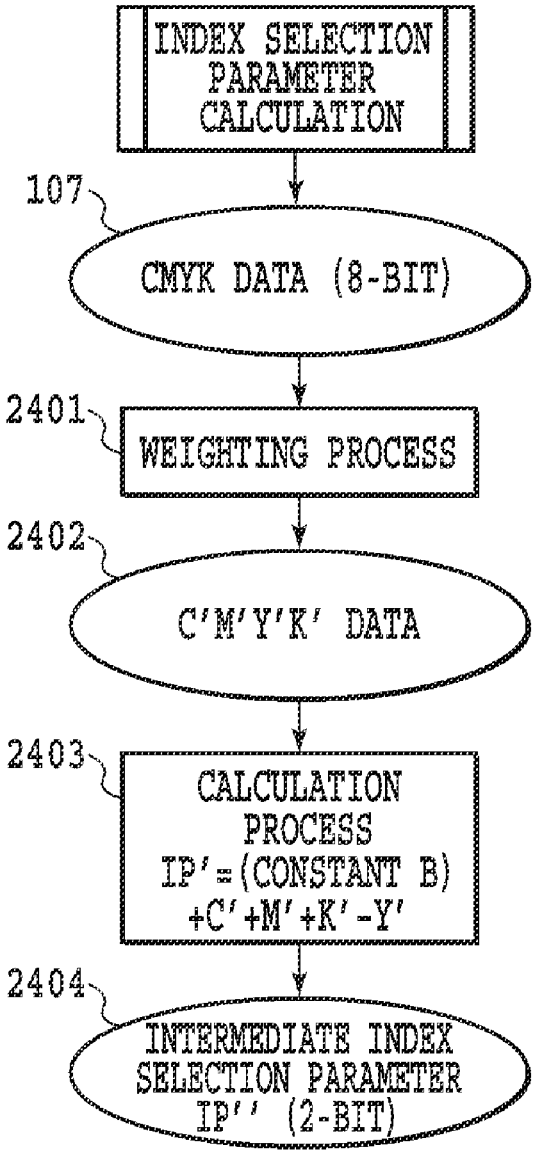
FIG. 24 is a diagram for concretely describing the process by which a multi-valued index selection parameter is calculated, the parameter being used in the fifth embodiment of the present invention.
Figure 25A:
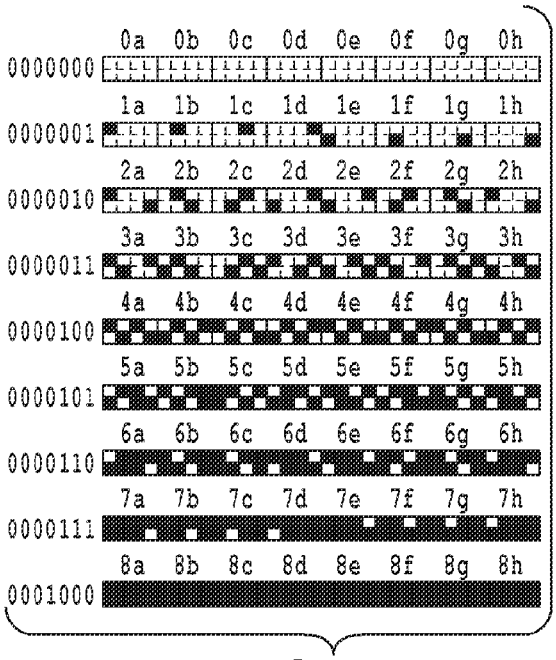
FIGS. 25A to 25D are schematic diagrams for illustrating a portion of the tone data and the index patterns used in the fifth embodiment of the present invention.
Figure 25C:
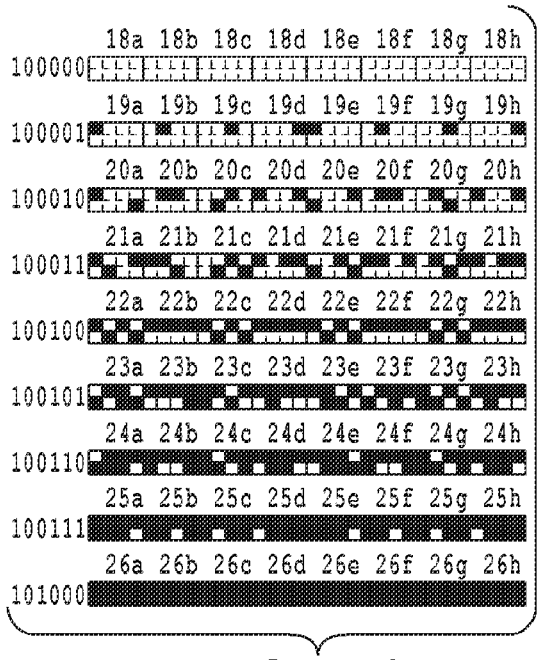
Figure 25B:
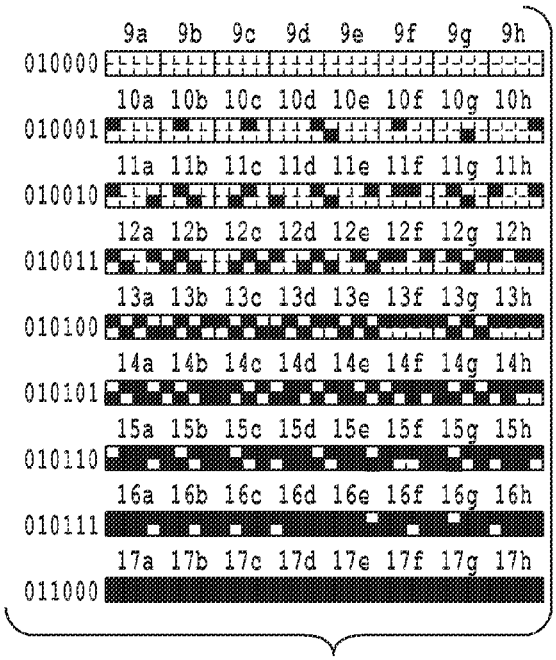
Figure 25D:
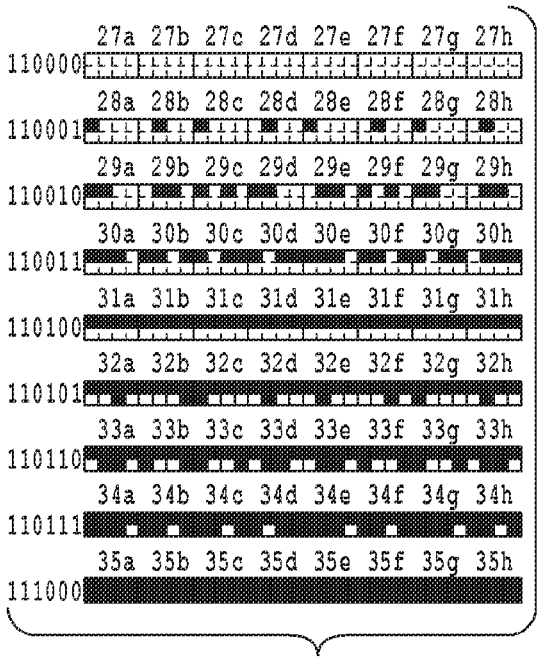

FIG. 24 is a flowchart for describing the calculation steps in the multi-value index selection parameter calculation process 2310. In this process, the CMYK density data 107 is first subject to a weighting process 2401, wherein the data 107 is multiplied by a predetermined weighting coefficient having a value in the range of 0-1, and wherein any fractional values generated thereby are truncated. In so doing, new density data C'M'Y'K' 2402 is obtained.

In the subsequent step 2403, a multi-value index selection parameter IP" 2204 is computed using a constant B prepared in advance. This parameter is given as IP"=C'+M'+K'−Y'+B, and is computed as 2-bit (4 values) data, the last 6 bits having been truncated.

Table 5 shows an example of per-color 256-tone (8-bit) CMYK density data 107 input into the multi-value index selection parameter calculation process 2310, as well as the converted values of these data given by the weighting process 2401 and the calculation process 2403. In this example, the weighting coefficient for C, M, and K is 0.16, the weighting coefficient for Y is 0.5, and the constant B is 128. It can be seen that in the present embodiment, similarly to the fourth embodiment, when the Y density value is low compared to the other colors, the multi-value index selection parameter IP" becomes a comparatively large value. When the Y density value is high compared to the other colors, the multi-value index selection parameter IP" becomes a comparatively small value. When the multi-value index selection parameter IP" exhibits a large value, the probability increases that the 2-bit multi-value index selection parameter IP 2311 will exhibit a large value. However, since the number of bits truncated in the calculation process 2403 is large for the multi-value index selection parameter IP" of the present embodiment, the parameter becomes a small value compared to the index selection parameter IP' indicated in Table 4.

TABLE 5

| | | density data | Weighting coefficient | Weighting calculation result | Calculation constant B | Post-calculation process value | IP" after last 6 bits are truncated |
|---|---|---|---|---|---|---|---|
| Data | C | 255 | C 0.16 | 40 | 128 | 238 | 3 |
| Example 1 | M | 255 | M 0.16 | 40 | | | |
| | Y | 20 | Y 0.5 | 10 | | | |
| | K | 255 | K 0.16 | 40 | | | |
| Data | C | 20 | | 3 | | 132 | 2 |
| Example 2 | M | 20 | | 3 | | | |
| | Y | 20 | | 10 | | | |
| | K | 50 | | 8 | | | |
| Data | C | 0 | | 0 | | 1 | 0 |
| Example 3 | M | 0 | | 0 | | | |
| | Y | 255 | | 127 | | | |
| | K | 0 | | 0 | | | |

Referring again to the flowchart in FIG. 23, in the present embodiment, the 4-bit CMYK data obtained by the 4-bit data conversion process 108, as well as the 2-bit multi-value index selection parameter IP 2311 obtained by the multi-value index selection parameter calculation process 2310, are input into the Y data conversion process 2312. The Y data conversion process 2312 of the present embodiment appends the 2-bit data of the multi-value index selection parameter IP" to the front of the 4-bit yellow data, thereby converts the yellow data into new 6-bit data. As a result, by conducting the Y data conversion process 2312, tone information (2313) is output wherein cyan, magenta, and black have 9 values in the range of 0000-1000, while yellow has values in the range of 000000-111000. In the tone information 2313, lower 4 bits become information indicating the number of dots to be printed on individual unit pixels. On the other hand, by performing the following processing, higher-order 2 bits ultimately become information specifying the nozzle positions whereby the dots are to be printed as well as the scan used to print the dots.

FIGS. 25A-25D are schematic diagrams for describing the yellow index patterns used in the present embodiment. In the diagrams, the tone information 000000-111000 shown on the left indicates the 6-bit data values of the yellow data after the Y data conversion process. For cyan, magenta, and black, index patterns have been respectively selected that correspond to the lower 4 bits shown in FIG. 25A. The mask patterns used for each color are those shown in FIG. 12, as in the foregoing embodiments.

Referring to FIG. 25A-25D, it can be seen that as the value of the higher-order 2 bits increases (i.e., as the ratio of ink other than yellow to yellow ink increases), the pixels wherein dots are to be printed collect in the upper row. In the present embodiment, by changing the contents of the index patterns in this way for the unit pixels whose ratios of non-specific ink to specific ink are greater than a predetermined ratio, most of the yellow dots are printed by the regions 5-8 of the print head, due to the change of the index patterns causing the mask patterns as shown in FIG. 12. In other words, printing is controlled such that most of the yellow dots are applied to the print medium later than the other colors. Meanwhile, for unit pixels whose ratios of non-specific ink to specific ink are less than a set ratio, the index patterns are not changed, and index patterns having little bias in nozzle usage frequency are applied.

In the foregoing description, a 2-bit selection parameter is appended to 4-bit yellow density data as a parameter for selecting index patterns. However, this information is not to be limited to the above-described embodiment. The multi-value index selection parameter IP" may also be stored in a region separate from the 4-bit yellow density data.

As a result of the above-described embodiment, the ratio of specific ink to be applied by the last half of plural scans or the final scan of the of plural scans increases for unit pixels having a ratio of non-specific ink to specific ink that is greater than a predetermined ratio. As a result, the probability increases that the specific ink will be applied by a later scan than the non-specific ink. In so doing, the specific ink, being excellent in scratch resistance properties, can be applied later than the other non-specific inks, and thus the scratch resistance properties of the image can be improved.

In the five embodiments described above, the object of the invention is taken to be improving the scratch resistance of overall an image by utilizing the fact that the scratch resistance of the yellow ink used is favorable compared to the other inks. However, the invention is not limited to such an object. As long as the object is to achieve control over the application order of two or more types of ink, that object is considered to be an object of the invention regardless of particulars. For example, a light type ink having a lower concentration of colorant than ordinary ink could be prepared, and a component for improving scratch resistance properties, such as wax and etc., could be included in this ink. Embodiments that control the scans used to print the light type ink instead of yellow ink would fall under the scope of the present invention. In this case, the light type ink would correspond to the "specific ink".

In addition, in the case of an embodiment using transparent ink which does not contain colorant, and wherein this transparent ink is the ink superior in scratch resistant properties, the transparent ink would correspond to the "specific ink". In this way, the "specific ink" may also be transparent ink. Consequently, embodiments wherein the specific ink is transparent ink and the non-specific ink is non-transparent ink (i.e., colored ink containing colorant) also fall within the scope of the present invention.

In addition, the "specific ink" is not limited to one ink type, and may be a plurality of ink types. For example, for embodiments using the four types of ink CMYK as in the above embodiments, the two ink types CY may be specified as the "specific ink", and the two ink types MK may be specified as the "non-specific ink".

In addition, in the above embodiments, all of the non-specific ink (CMK) applying amount information is taken into account when determining the one or more scans used to apply the specific ink (Y). However, embodiments wherein only a portion of the non-specific ink (e.g., MK) applying amount information is taken into account may also be used. In other words, not only the non-specific ink (e.g., MK) involved with the specific ink (Y) application scan determination, but also the non-specific ink (e.g., C) that is not involved with the specific ink (Y) application scan determination, may be provided. For example, in the case of the fourth embodiment, during the index selection parameter calculation 2110, non-specific ink (e.g., C) that is not involved with the calculation is provided. In this way, embodiments wherein two types of non-specific ink are provided (i.e., non-specific ink that is involved with the specific ink application scan determination and non-specific ink that is not involved with the specific ink application scan determination) also fall within the scope of the present invention.

In addition, the present invention can be applied to cases wherein it is desirable to more optimally express the color of secondary colors, rather than improve scratch resistance. For example, when forming identical green images, it is conceivable that for some cases more preferable coloring can be obtained by applying ink in the order yellow cyan, rather than the order cyan yellow. In this case, by converting the signal values from 1000 to 1111, as shown in FIG. 11B, of the cyan data to be printed in the same unit pixel as yellow, green images with superior coloring can be reliably obtained. In the case of such embodiments, the cyan ink corresponds to the "specific ink".

Furthermore, the present invention can also be suitably used for controlling the application order of color inks, with a more proactive enlargement of the color gamut as an object.

Figure 18:
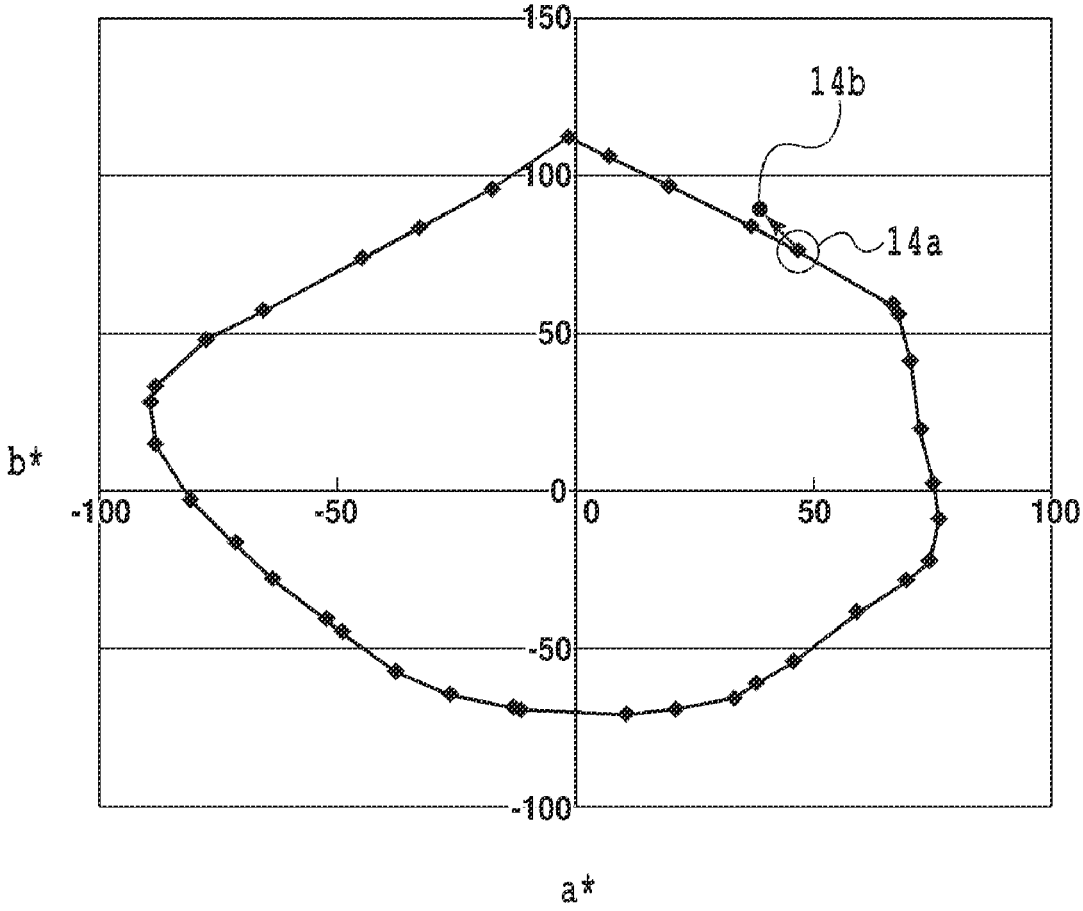
FIG. 18 is a chromaticity diagram for describing a concrete example of enlarging the color gamut.

FIG. 18 is a chromaticity diagram for describing a concrete example of enlarging the color gamut in this way. The region enclosed by the solid line is the region obtained by taking all colors expressible on a host device, actually printing these colors using the printing apparatus W8400 made by Canon Inc., measuring the printed material, and then projecting the obtained gamut onto the planar surface a*b*. The print medium used in obtaining this data was "Glossy Photo Paper (Light)" made by Canon Inc. This chromaticity diagram was obtained via typical printing methods, i.e., via multi-pass printing wherein the print ratios of all colors are equally distributed over every print scan. In the drawing, the point 14*a*, for example, indicates the location of a red color with a strong yellow tint. In contrast, by conducting a control in the opposite direction of those of the foregoing embodiments, in other words, by conducting a control such that yellow ink is applied first, the point 14*a* can be moved to the point 14*b*. As a result, it becomes possible to express a red color with an even stronger yellow tint, thus widening the reproducible color gamut. In the present case, a strong yellowish-red hue was described by way of example, but as long as an ink application order control such as this is applied between the edge of the color gamut and the entire spectrum, the color gamut can be enlarged over a wider region. In this case, the yellow ink, being equivalent to the "specific ink", corresponds to the ink controlled so as to be applied before the other inks. To perform a control such that the specific ink will be applied before the non-specific ink, a control that is the reverse of the above first through fifth embodiments may be conducted. In other words, the ratio of specific ink applied by the first half of plural scans is increased for unit pixels to which specific ink is to be applied together with non-specific ink, or for unit pixels whose ratio of non-specific ink to specific ink is greater than a predetermined ratio. In so doing, the ratio of specific ink applied by a scan before the non-specific ink is ultimately increased. In addition, it is preferable to perform a control such that the ratio of specific ink applied by the first half of plural scans among the specific inks applied by plural scans becomes greater than the ratio of non-specific ink applied by the first half of plural scans among the non-specific inks applied by the plural scans.

In the above-described embodiments, the entire series of image processing steps described in FIGS. 9, 21, and 23 is conducted via software processing on the host computer, whereas index patterning process and mask processing is conducted on the printing apparatus. However, the invention is not limited to such a printing system that includes a host device and a printing apparatus. Embodiments wherein the above series of image processing steps, the index patterning process, and the mask processing are all conducted on the printing apparatus may be used. In addition, embodiments wherein the above series of image processing steps, the index patterning processing, and the mask processing are all conducted on the host device may also be used.

As a result of the above-described embodiments, the application order of yellow ink is suitably controlled only for the case of mixed-color images, without introducing bias in the print ratios of the mask patterns for each region seen in the related art. Consequently, a large amount of memory need not to be reserved in the apparatus for the new mask patterns, and the lifetime of the yellow print head is not shortened more than necessary.

This kind of control is conducted herein based on the superior scratch resistance of yellow ink. However, the degree of scratch resistance fluctuates according to the type of print media printed upon and other factors. Consequently, if a plurality of printing modes are prepared in advance, and if the above-described methods are implemented only for a mode emphasizing scratch resistance, nozzle usage bias can be significantly alleviated.

In addition, in the above-described embodiments, a signal value conversion that changes the highest-order bit of the yellow data is conducted during the last stage of the image processing conducted at the host device (step 110 of FIG. 9). However, the invention is not to be limited thereto. This type of processing can be conducted at any stage in the flowchart. If the unit pixels wherein yellow and another ink are to be printed simultaneously can be confirmed, the yellow data conversion processing can be conducted even at the multi-value stage before the 4-bit data conversion process 108.

In addition, in the foregoing it was described that the multi-pass mask patterns and the index patterns except yellow are used in common for all colors. However, the invention is not to be limited thereto, and suitable mask patterns and index patterns may be prepared for each color. For example, it is possible to define the tone values of 1000-1111, these values not being used for other than yellow in the foregoing description, as different patterns in the case of other colors. In addition, although the index rotation described above is conducted in the main scan direction, this index rotation may also be applied in the vertical direction.

Furthermore, although in the foregoing embodiments 8-pass and 16-pass multi-pass printing are described by way of example, it is understood that other multi-pass numbers may also be used. In addition, regardless of whether the print scan of the print head is unidirectional or bidirectional, virtually identical advantages of the present embodiments can be obtained.

In the above-described embodiments, a printing method is described wherein yellow ink is applied later than other ink. However, if an ink superior in scratch resistance properties exists, similar advantages can be obtained by converting the signal values of this ink similarly to the above yellow data. In addition, if an ink with particularly poor scratch resistant properties compared to other inks exists, by taking this ink as the specific ink and adapting the foregoing printing method, a printing method can be implemented such that the specific ink is applied earlier than the other inks. In addition, the basis for distinguishing the specific ink from the non-specific ink is not limited to the above scratch resistant properties or coloring properties. If some advantage regarding an aspect occurring in an image can be obtained by applying a specific ink later than (or earlier than) a non-specific ink, the configuration of the present invention as described above will function effectively.

It is a characteristic of the invention that not only the applying amount information for the specific ink, but also the applying amount information for the non-specific ink is taken into account when determining the one or more scans used to apply the specific ink with respect to a unit pixel. Specifically, a unit pixel satisfying a predetermined condition is specified based on these sets of applying amount information, and for a unit pixel specified in this way, a control is conducted to increase the ratio of specific ink that is used by specified one or more scans (the last half of the plural scans, the final scan of the plural scans, or the first half of the plural scans). In so doing, the specific ink is concentrated on using in the last half of the plural scans or the first half of the plural scans, and thus it becomes possible to apply the specific ink late or early, relative to the non-specific ink. Thus, configurations fulfilling such conditions are also included in the scope of the present invention, even if there is no special relationship between the index patterns and the mask patterns. The special relationship between the index patterns and the mask patterns in the foregoing embodiments is simply one method implemented in order to realize the above configuration. However, with the method described in the foregoing embodiments, the objects of the invention can be realized with a relatively simple configuration, and for this reason this printing method of the foregoing embodiments can be said to be effective for the present invention.

Furthermore, the present invention is also realized via program code that realizes the functions of the above characteristic processing (i.e., processing to determine the one or more scans used to apply the specific ink), or alternatively, via a print medium storing such program code. In this case, the foregoing processing is realized using a system or computer of the apparatus (or a CPU or MPU) that reads and executes the above program code. In this way, a program that executes, on a computer, the above-described characteristic processing, or alternatively, a storage medium storing this program, is also included in the invention.

Components which may be used as the storage medium for supplying the program code include, for example, floppy disks, hard disks, optical discs, magnet optical disks, CD-ROMs, CD-Rs, magnetic tape, nonvolatile memory cards, and ROM. Moreover, the invention may also be configured such that, by executing the program code read by the computer, the functions of the above embodiments are realized, but wherein the OS operating on the computer conducts all or a portion of the actual processing, based on the commands of the program code.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2006-341390, filed Dec. 19, 2006 which is hereby incorporated by reference herein in its entirety.

What is claimed is:

1. An inkjet printing apparatus for performing printing on a unit pixel of a print medium by plural scans of a print head for applying a plurality of inks including a first ink and a second ink, the apparatus comprising:

an obtaining unit that obtains applying amount information on amounts of respective inks to be applied to the unit pixel; and a determining unit that determines, for the respective inks, one or more scans used to apply the ink to the unit pixel among the plural scans on the basis of the applying amount information obtained by said obtaining unit;

wherein said determining unit determines the one or more scans used to apply the first ink on the basis of the applying amount information for the first ink and the second ink and determines the one or more scans used to apply the second ink on the basis of the applying amount information for the second ink; and wherein said determining unit (i) specifies the unit pixel that satisfies a predetermined condition on the basis of the applying amount information for the first ink and the second ink, and (ii) determines the one or more scans used to apply the first ink such that the ratio of first ink applied in the last half of the plural scans is greater for the specified unit pixel that satisfies the predetermined condition than for a unit pixel that does not satisfy the predetermined condition.

2. The inkjet printing apparatus according to claim 1, wherein the unit pixel that satisfies the predetermined condition is a unit pixel to which the first ink is to be applied together with the second ink, and wherein the unit pixel that does not satisfy the predetermined condition is a unit pixel to which the first ink is to be applied singly.

3. The inkjet printing apparatus according to claim 1, wherein the unit pixel that satisfies the predetermined condition has an application ratio of second ink to the first ink that is greater than a predetermined ratio, and wherein the unit pixel that does not satisfy the predetermined condition has an application ratio of second ink to the first ink that is less than the predetermined ratio.

4. The inkjet printing apparatus according to claim 1, wherein the unit pixel that satisfies the predetermined condition has an application ratio of second ink to the first ink that is greater than a predetermined ratio, and wherein said determining unit determines, for the unit pixel that satisfies the predetermined condition, the one or more scans used to apply the first ink such that as the application ratio of second ink to the first ink increases, the probability that the first ink will be applied by the last half of the plural scans increases.

5. The inkjet printing apparatus according to claim 1, wherein said determining unit determines, for the unit pixel that satisfies the predetermined condition, the one or more scans used to apply the first ink as well as one or more scans used to apply the second ink such that the first ink is applied by one or more scans later than the second ink.

6. The inkjet printing apparatus according to claim 1, wherein for the unit pixel that satisfies the predetermined condition, said determining unit determines the one or more scans used to apply the first ink as well as one or more scans used to apply the second ink such that the ratio of first ink applied by the last half of the plural scans among the first ink applied by the plural scans is greater than the ratio of the second ink applied by the last half of the plural scans among the second ink applied by the plural scans.

7. The inkjet printing apparatus according to claim 1, wherein the first ink is yellow ink, and the second ink includes cyan ink, magenta ink, and black ink.

8. The inkjet printing apparatus according to claim 1, wherein the first ink is transparent ink, and the second ink is non-transparent ink.

9. The inkjet printing apparatus according to claim 1, wherein the first ink is more scratch resistant than the second ink.

10. The inkjet printing apparatus according to claim 1, wherein the applying amount information is multi-valued density information.

11. An inkjet printing method for performing printing on a unit pixel of a print medium by plural scans of a print head for applying a plurality of inks including a first ink, the method comprising the steps of:

obtaining applying amount information on amounts of respective inks to be applied to the unit pixel; and determining, for the respective inks, one or more scans used to apply the ink to the unit pixel among the plural scans, on the basis of the applying amount information obtained in said obtaining step;

wherein said determining step determines the one or more scans used to apply the first ink on the basis of the applying amount information for the first ink and the second ink other than the first ink and determines the one or more scans used to apply the second ink on the basis of the applying amount information for the second ink; and wherein said determining step (i) specifies the unit pixel that satisfies a predetermined condition on the basis of the applying amount information for the first ink and the second ink, and (ii) determines the one or more scans used to apply the first ink such that the ratio of first ink applied in the last half of the plural scans is greater for the specified unit pixel that satisfies the predetermined condition than for a unit pixel that does not satisfy the predetermined condition.

12. A printing system, including an inkjet printing apparatus for performing printing on a unit pixel of a print medium by plural scans of a print head for applying a plurality of inks including a first ink, and a host device for supplying information for performing printing to the inkjet printing apparatus, the system comprising:

an obtaining unit that obtains applying amount information on amounts of respective inks to be applied to the unit pixel; and a determining unit that determines, for the respective inks, one or more scans used to apply the ink to the unit pixel among the plural scans, on the basis of the applying amount information obtained by said obtaining unit;

wherein said determining unit determines the one or more scans used to apply the first ink on the basis of the applying amount information for the first ink and the second ink other than the first ink and determines the one or more scans used to apply the second ink on the basis of the applying amount information for the second ink; and wherein said determining unit (i) specifies the unit pixel that satisfies a predetermined condition on the basis of the applying amount information for the first ink and the second ink, and (ii) determines the one or more scans used to apply the first ink such that the ratio of first ink applied in the last half of the plural scans is greater for the specified unit pixel that satisfies the predetermined condition than for a unit pixel that does not satisfy the predetermined condition.

* * * * *